United States Patent [19]

Aoki et al.

[11] Patent Number: 5,037,730

[45] Date of Patent: Aug. 6, 1991

[54] SILVER HALIDE PHOTOGRAPHIC LIGHT-SENSITIVE MATERIAL CONTAINING A CYAN COUPLER AND EPOXY COMPOUND

[75] Inventors: Kozo Aoki; Osamu Takahashi, both of Kanagawa, Japan

[73] Assignee: Fuji Photo Film Co., Ltd., Kanagawa, Japan

[21] Appl. No.: 622,118

[22] Filed: Dec. 6, 1990

Related U.S. Application Data

[63] Continuation of Ser. No. 220,756, Jul. 18, 1988, abandoned.

[30] Foreign Application Priority Data

Jul. 17, 1987 [JP] Japan ..... 62-178702

[51] Int. Cl.[5] ..... G03C 1/10; G03C 7/32

[52] U.S. Cl. ..... 430/551; 430/552; 430/553; 430/546

[58] Field of Search ..... 430/551, 552, 553, 546

[56] References Cited

U.S. PATENT DOCUMENTS

| | | | |
|---|---|---|---|
| 4,239,851 | 12/1980 | Aoki et al. | 430/377 |
| 4,540,657 | 9/1985 | Krishnamurthy | 430/546 |
| 4,748,100 | 5/1988 | Umemoto et al. | 430/505 |
| 4,770,985 | 9/1988 | Takada et al. | 430/505 |

*Primary Examiner*—Charles L. Bowers, Jr.
*Assistant Examiner*—Janet C. Baxter
*Attorney, Agent, or Firm*—Sughrue, Mion, Zinn Macpeak & Seas

[57] ABSTRACT

A silver halide photographic light-sensitive material comprising at least one type of cyan dye-forming coupler represented by formula (I) below and at least one type of difficulty water-soluble epoxy represented by formula (II) below:

(I)

(II)

wherein $R_1$ represents an alkyl group having at least 7 carbon atoms, $R_2$ represents an alkyl group with 2 to 15 carbon atoms, L represents a simple linkage or a bivalent linking group, Z represents a hydrogen atom, or a group or atom which can be released at the time of the coupling with the developing agent, $R_3$, $R_4$, $R_5$ and $R_6$ each represents a hydrogen atom, an aliphatic group, an aliphatic oxycarbonyl group, an aromatic oxycarbonyl group or a carbamoyl group, provided that $R_3$, $R_4$, $R_5$ and $R_6$ are not all hydrogen atoms, and the total number of carbon atoms thereof is from 8 to 60, and in formula (II), a 5- to 7-membered ring may be formed with $R_3$ and $R_4$ or $R_3$ and $R_5$, respectively.

12 Claims, No Drawings

SILVER HALIDE PHOTOGRAPHIC LIGHT-SENSITIVE MATERIAL CONTAINING A CYAN COUPLER AND EPOXY COMPOUND

This is a continuation of U.S. application Ser. No. 07/220,756, filed July 18, 1988 abandoned.

FIELD OF THE INVENTION

The present invention relates to a silver halide photographic light-sensitive material, and in particular to a silver halide photographic light-sensitive material which has a difficultly water-soluble epoxy and has improved color image stability.

BACKGROUND OF THE INVENTION

By means of the color development treatment following the exposure of a silver halide light-sensitive material to light, a reaction takes place between the aromatic primary amine developing agent, which has been oxidized by the silver halide, and a dye-forming coupler, and a color image is formed.

In this method, color reproduction by the subtractive method is commonly used, and to reproduce blue, green and red colors, yellow, magenta and cyan color images, which are in a complementary color relation, respectively, are formed.

Conventionally, phenols or naphthols are mainly used as the couplers for forming the cyan color image. However, a number of problems exist in terms of the stability of the color image obtained from conventional phenols and naphthols. For example, in U.S. Pat. Nos. 2,367,531, 2,369,929, 2,423,730 and 3,772,002, etc., there are disclosed color images obtained from 2-acylaminophenol cyan couplers, but these, in general, have poor fastness to heat. Also, color images obtained from 2,5-diacylaminophenol cyan couplers as described in U.S. Pat. Nos. 2,772,162 and 2,895,826, in general, have the disadvantage of poor light fastness. Further, color images obtained from the 2-ureidophenol cyan couplers as described in U.S. Pat. Nos. 3,446,622 and 4,333,999, in general, have poor light fastness, while the 1-hydroxy-2-naphthamido cyan couplers, in general, are inadequate both in terms of light and heat fastness (especially wet heat fastness).

A color image obtained from a phenolic coupler having a chain or branched alkyl group in the ballast group as described in JP-A-61-39045 (the term "JP-A" as used herein means an "unexamined published Japanese patent application") has outstanding fastness to light and heat, but has the disadvantage that, following treatment, regions which were unexposed to light are nonetheless stained cyan.

Attempts to improve fastness in the case of the cyan coupler using an epoxy type coupler solvent have been described in U.S. Pat. Nos. 4,239,851 and 4,540,657, and in JP-A-62-75447, but while an improvement in fastness is noted with the combinations of epoxy compound and cyan coupler actually described in these specifications, the improvement cannot be said to be sufficient. Further, there is practically no effect with respect to the unacceptable cyan staining of the unexposed regions.

SUMMARY OF THE INVENTION

One object of the present invention lies in offering silver halide photographic light-sensitive materials which form colored images of outstanding fastness to light and heat.

Another object of the present invention lies in offering silver halide photographic light-sensitive materials which do not cause the unexposed white regions (i.e., white margins) to be improperly stained with a cyan color.

The objects of the present invention may be realized by providing a silver halide photographic light-sensitive material comprising at least one type of cyan dye-forming coupler represented by formula (I) below and at least one type of difficultly water-soluble epoxy represented by formula (II):

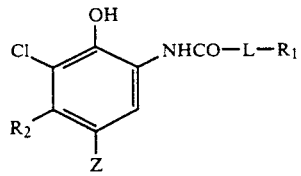

(I)

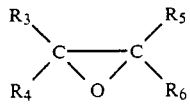

(II)

wherein $R_1$ represent an alkyl group having at least 7 carbon atoms, $R_2$ represents an alkyl group with 2 to 15 carbon atoms, L represents a simple linkage or a bivalent linking group, Z represents a hydrogen atom, or a group or atom which can be released at the time of the coupling with the developing agent, $R_3$, $R_4$, $R_5$ and $R_6$ each represents a hydrogen atom, an aliphatic group, an aliphatic oxycarbonyl group, an aromatic oxycarbonyl group or a carbamoyl group, provided that $R_3$, $R_4$, $R_5$ and $R_6$ are not all hydrogen atoms, and the total number of carbon atoms thereof is from 8 to 60, and in formula (II), a 5- to 7-membered ring may be formed with $R_3$ and $R_4$ or $R_3$ and $R_5$, respectively.

In the specification of the present patent application, "difficultly water-soluble" means that the solubility in water at 25° C. will be no more than 10 wt %, and the epoxy of the present invention will be employed by using a surfactant to achieve emulsion dispersion, either along with the coupler or separately, in a hydrophilic binder such as an aqueous gelatin solution, etc. It is also possible at this time to use a difficultly water-soluble high boiling organic solvent of boiling point 160° C. or more, or a low boiling auxiliary organic solvent. Again, while the coupler and difficultly watersoluble epoxy may be present in separate layers, it is preferred that they are present in the same layer, especially in the same oil droplets. It is also preferred that they are coemulsified and dispersed in the form of fine grains in a silver halide emulsion layer.

Below, $R_1$, $R_2$, $R_3$, $R_4$, $R_5$, $R_6$, L and Z in formulae (I) and (II) will be explained in detail.

$R_1$ in formula (I) represents an alkyl group with at least 7 carbon atoms (e.g., octyl, tert-octyl, tridecyl, pentadecyl, eicosyl), preferably a straight chain alkyl group with 10 to 22 carbon atoms.

L in formula (I) represents a simple linkage or a bivalent linking group.

Here, the bivalent linking group represents an alkylene, phenylene, ether linkage, carbonamido linkage, sulfonamido linkage, ester linkage or urethane linkage, etc., and combinations of such groups. Examples of such combinations are set forth below. However, the present invention should not be construed as being limited to these examples.

$-CH_2)_3O-$ I-A $-CH_2O-$ I-B

I-C

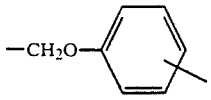

(ortho-, meta- or para-; so too below)

I-D

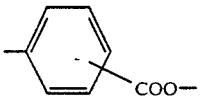

I-E

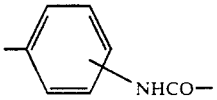

I-F

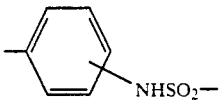

I-G

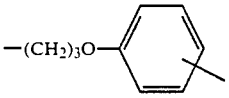

I-H

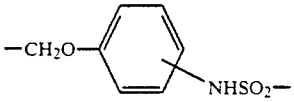

$R_2$ in formula (I) represents an alkyl group with 2 to 15 carbon atoms (e.g., ethyl, butyl, tertbutyl, cyclohexyl, pentadecyl), preferably an alkyl group with 2 to 4 carbon atoms, and with the ethyl group being most preferred.

Z in formula (I) represents a hydrogen atom or a group released upon coupling, examples of which are a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy), an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluenesulfonylamino), an alkoxycarbonyloxy group (e.g., ethoxycarbonyloxy, benzyloxycarbonyloxy), an aryloxycarbonyloxy group (e.g., phenoxycarbonyloxy), an aliphatic or an aromatic thio group (e.g., ethylthio, phenylthio, tetrazolylthio), an imido group (e.g., succinimido, hydantoinyl), an aromatic azo group (e.g., phenylazo), and the like. These releasable groups may include photographically useful groups.

Preferably, in formula (I), Z will be a hydrogen atom or a halogen atom, among which a chlorine atom or a fluorine atom is most preferred.

In formula (II), $R_3$, $R_4$, $R_5$ and $R_6$ each represents a hydrogen atom, an aliphatic group, an aliphatic oxycarbonyl group (e.g., dodecyloxycarbonyl, allyloxycarbonyl), an aromatic oxycarbonyl group (e.g., phenoxycarbonyl) or a carbamoyl group (e.g., tetradecylcarbamoyl, phenylmethylcarbamoyl), but $R_3$, $R_4$, $R_5$ and $R_6$ are not all at the same time hydrogen atoms, and the total number of carbon atoms thereof is from 8 to 60.

In this specification, "aliphatic group" represents an aliphatic hydrocarbon group which may be straight chained, branched or cyclic, and the meaning will include both saturated and unsaturated groups such as an alkyl group, an alkenyl group and an alkynyl group. Typical examples are a methyl group, an ethyl group, a butyl group, a dodecyl group, an octadecyl group, an eicosenyl group, an isopropyl group, a tert-butyl group, a tert-octyl group, a tert-dodecyl group, a cyclohexyl group, a cyclopentyl group, an allyl group, a vinyl group, a 2-hexadecenyl group and a propargyl group, etc.

In formulae (I) and (II), the alkyl groups, aliphatic groups, aromatic groups and linking groups capable of substitution (e.g., alkylene, phenyleneamido linkages) may also be further substituted with a group or groups selected from an alkyl group, an aryl group, a heterocyclic group, an alkoxy group (e.g., methoxy, 2-methoxyethoxy), an aryloxy group (e.g., 2,4-di-tertamylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, ethylcarbamoyl, dimethylcarbamoyl, methanesulfonamido, butylsulfamoyl), a sulfamido group (e.g., dipropylsulfamoylamino), an imido group (e.g., succinimido, hydantoinyl), a ureido group (e.g., phenylureido, dimethylureido), an aliphatic or an aromatic sulfonyl group (e.g., methanesulfonyl, phenylsulfonyl), an aliphatic or an aromatic thio group (e.g., ethylthio, phenylthio), a hydroxyl group, a cyano group, a carboxyl group, a nitro group, a sulfo group and a halogen atom, etc.

Below, some specific examples of the compounds represented by formula (I) and formula (II), which can be used in the present invention, are given, but the present invention is not to be construed as being limited to these examples.

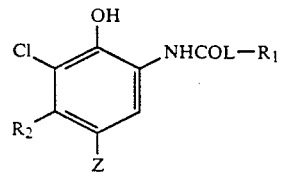

(I)

| Compound | $R_2$ | L | $R_1$ | Z |
|---|---|---|---|---|
| I-1 | $C_2H_5-$ | — | $-C_{11}H_{21}(n)$ | Cl |
| I-2 | " | " | $-C_{13}H_{27}(n)$ | " |

-continued
(I)
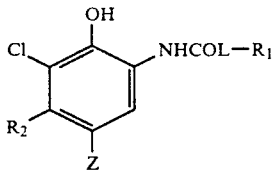
| Compound | $R_2$ | L | $R_1$ | Z |
|---|---|---|---|---|
| I-3 | " | " | $-C_{15}H_{31}(n)$ | " |
| I-4 | " | " | $-C_{17}H_{35}(n)$ | " |
| I-5 | " | " | $-C_{21}H_{43}(n)$ | " |
| I-6 | " | $-CH(OC_2H_5)-$ | $-C_{12}H_{25}(n)$ | " |
| I-7 | " | 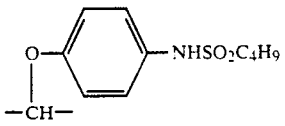 | " | " |
| I-8 | " | 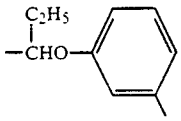 | $-C_{15}H_{31}(n)$ | " |
| I-9 | " | 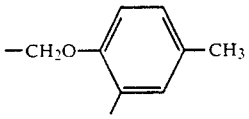 | $-C_{10}H_{21}(n)$ | " |
| I-10 | $(i)C_3H_7-$ | — | $-C_{17}H_{33}(n)$ | " |
| I-11 | $(n)C_4H_9-$ | " | $-C_{15}H_{31}(n)$ | F |
| I-12 | $(t)C_4H_9-$ | " | $-C_{13}H_{27}(n)$ | Cl |
| I-13 | $(n)C_{15}H_{31}-$ | " | $-C_9H_{19}$ | " |
| I-14 | $C_2H_5-$ | 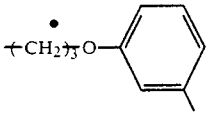 | $-C_{15}H_{31}$ | " |
| I-15 | " | 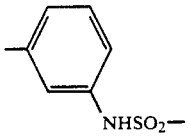 | $-C_{16}H_{33}(n)$ | " |
| I-16 | " | 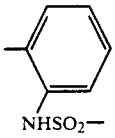 | $-C_{12}H_{25}(n)$ | " |
| I-17 | " | " | $-C_{17}H_{35}(iso)$ | " |
| I-18 | $(t)C_8H_{17}-$ | " | $-CH(C_2H_5)C_4H_9$ | " |
| I-19 | $C_2H_5-$ | 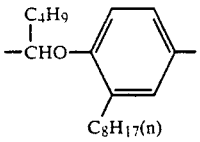 | $-C_8H_{17}(n)$ | " |

-continued
(I)
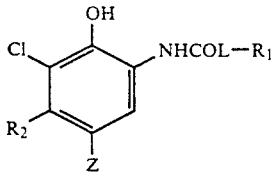
| Compound | $R_2$ | L | $R_1$ | Z |
|---|---|---|---|---|
| I-20 | " | 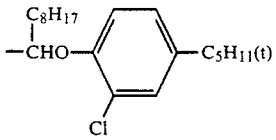 | " | " |
(II-1)
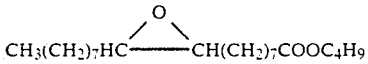
(II-2)
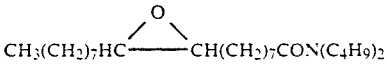
(II-3)
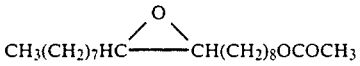
(II-4)
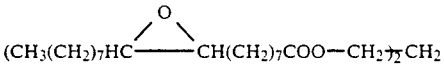
(II-5)
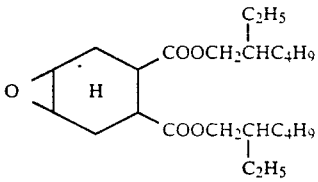
(II-6)
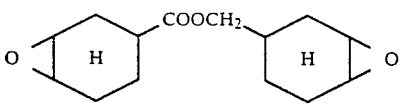
(II-7)
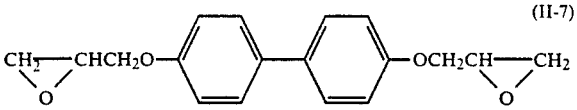
(II-8)
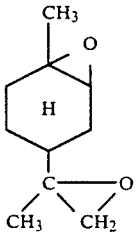
(II-9)
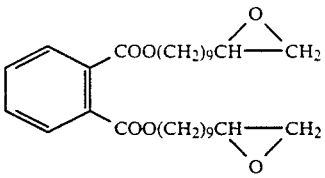
-continued
(II-10)
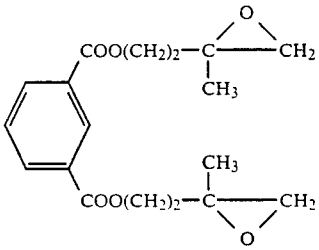
(II-11)
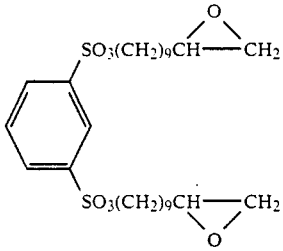
(II-12)
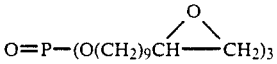
(II-13)
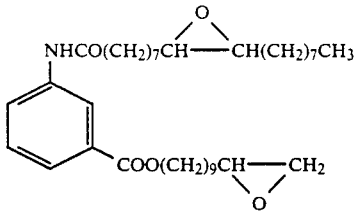
(II-14)
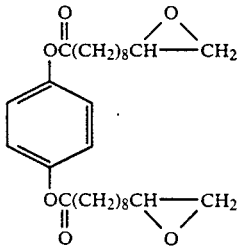
(II-15)
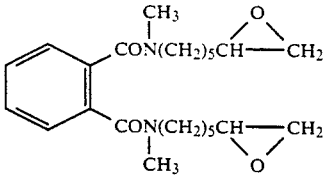

-continued (II-16)

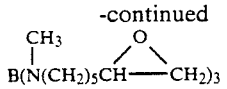

(II-17)

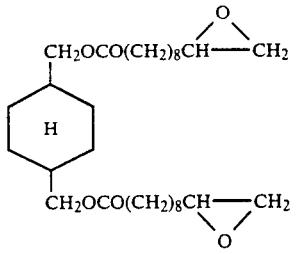

(II-18)

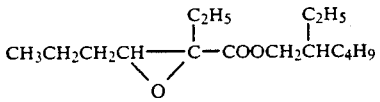

(II-19)

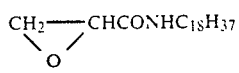

The present invention has an outstanding effect, namely, that by using an epoxy represented by formula (II) with a coupler of formula (I), which if used alone readily stains the white margin to a cyan color, the staining of this white margin is substantially eliminated. There is no indication at all of this effect in the aforementioned references, and it is a most remarkable effect.

In order to fully manifest the effects of the present invention, it is preferred that the amount of the epoxy represented by formula (II) used for 1 part by weight of the coupler of formula (I) lies in the range of 0.1 to 10 parts by weight, with 0.2 to 2 parts by weight still further preferred.

Two or more types of cyan coupler of formula (I) may be used, and again, it is also possible to use other known cyan couplers with the cyan coupler of formula (I) in the same layer, or in another layer. The known cyan couplers which are especially favorable for use in the invention can be represented by formula (C-I) below.

(C-I)

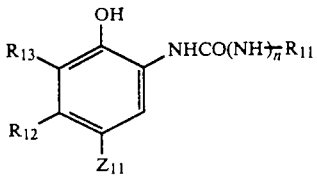

In formula (C-I), $R_{11}$ represents an aliphatic group, an aromatic group or a heterocyclic group, $R_{12}$ represents an aliphatic group, an aromatic group or an acylamino group, $R_{13}$ represents a hydrogen atom, a halogen atom, an aliphatic group, an aromatic group, an aliphatic or aromatic oxy group, or an acylamino group, $Z_{11}$ represents a hydrogen atom, or a group or atom which can be released by means of the oxidized coupling reaction with the developing agent, n represents 0 or 1, and $R_{12}$ and $R_{13}$ may be linked together to form a 5- to 7-membered ring.

Typical examples of the cyan couplers represented by formula (C-I) are the following. Again, these examples are not to be construed as limiting the present invention.

(C-1)

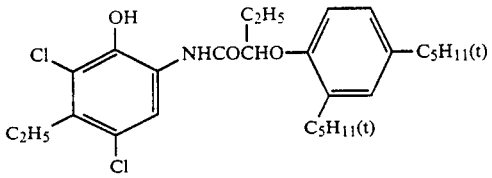

(C-2)

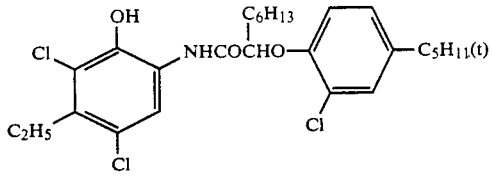

(C-3)

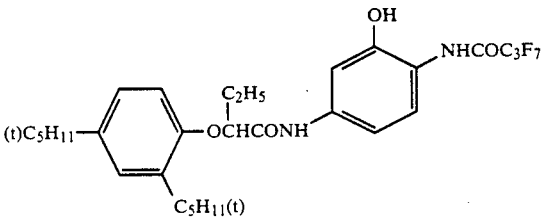

(C-4)

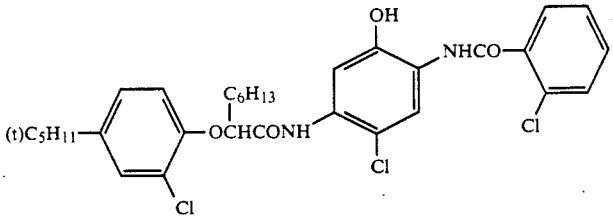

-continued
(C-5)
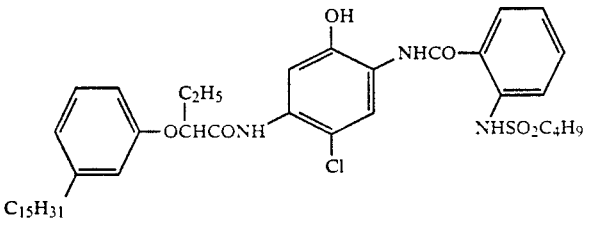
(C-6)
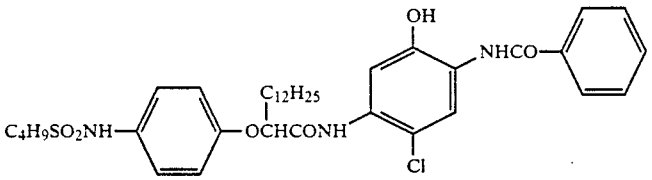
(C-7)
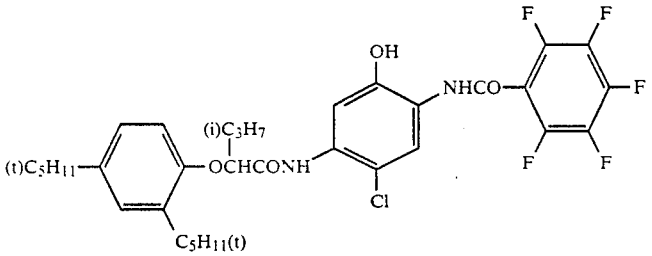
(C-8)
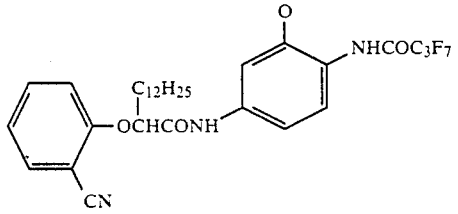
(C-9)
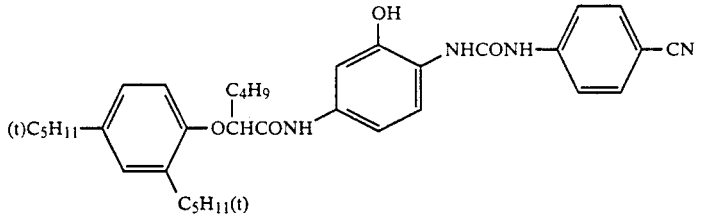
(C-10)
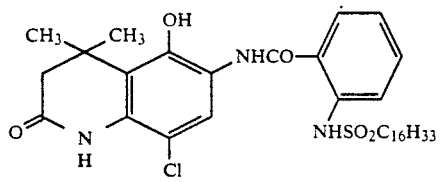
(C-11)
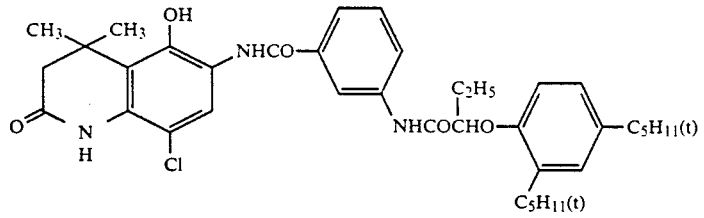

-continued (C-12)

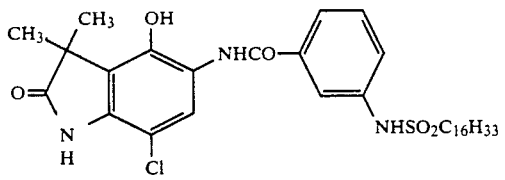

(C-13)

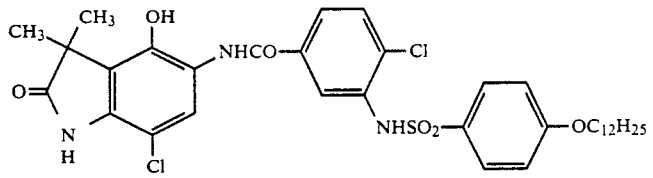

(C-14)

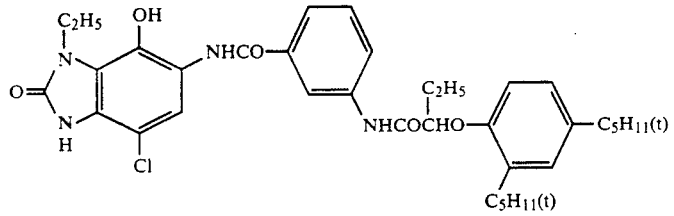

(C-15)

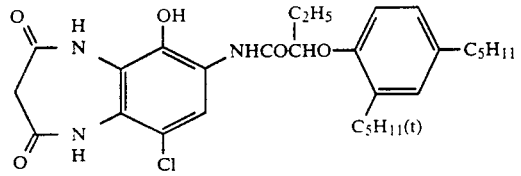

The coupler employed in the present invention can be introduced into the silver halide emulsion layer by conventional methods. In such circumstances, it is possible to employ as coupler solvents, ultraviolet light absorbers, protective colloids, binders, antifogging agents, color mixing preventing agents, antidiscoloring agents, sensitizing colorants, dyestuffs and bleaching agents, etc., which can be introduced along with the couplers, and again as methods for forming the silver halide light-sensitive materials (methods for forming the photographic emulsion, for introducing the coupler, etc., and for producing the layered structure of support and individual light-sensitive layers, etc.), those materials and methods, and those photographic treatments, etc., described in, or described in the references cited in, *Research Disclosure,* December, 1978, RD No. 17643 (Industrial Opportunities Ltd. UK), or in JP-A-56-65134 and 56-104333.

The amount of coupler of the present invention contained in the silver halide contained in the emulsion layer from which a light-sensitive layer is constructed is preferably from 0.1 to 1.0 mol, and more preferably from 0.1 to 0.5 mol.

In the present invention, the color photographic photosensitive materials can be produced by using magenta and yellow couplers in combination with at least one cyan coupler represented by formula (I).

Of the yellow couplers which can be used in the present invention, acylacetamide derivatives such as benzoylacetanilide and pivaloylacetanilide are preferred.

Among these, the compounds represented by formulae (Y-1) and (Y-2) are preferred as the yellow couplers.

(Y-1)

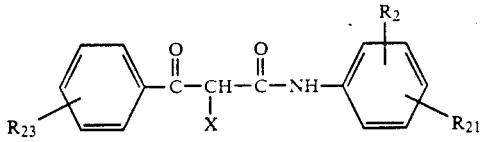

(Y-2)

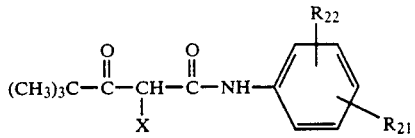

wherein X represents a hydrogen atom or a group released upon coupling, $R_{21}$ represents a nondiffusible group with a total of 8 to 32 carbon atoms, and $R_{22}$ represents a hydrogen atom, one or more halogen atoms, a lower alkyl group, a lower alkoxy group, or a nondiffusible group with a total of 8 to 32 carbon atoms, $R_{23}$ represents a hydrogen atom or a substituent group, in the case where there are two or more $R_{23}$ groups, these may be the same or different.

The details of the pivaloylacetanilide type yellow couplers are described between line 15 of column 3 and line 39 of column 8 in the specification of U.S. Pat. No. 4,622,287, and between line 50 of column 14 and line 41 of column 19 in the specification of U.S. Pat. No. 4,623,616.

The details of the benzoylacetanilide type yellow couplers are described in, for example, U.S. Pat. Nos. 3,408,194, 3,933,501, 4,046,575, 4,133,958 and 4,401,752.

Compounds (Y-1) to (Y-39), described between columns 37 and 54 in the specification of the aforesaid U.S.

Pat. No. 4,622,287, may be cited as specific examples of the pivaloylacetanilide type yellow coupler, among which (Y-1), (Y-4), (Y-6), (Y-7), (Y-15), (Y-21), (Y-22), (Y-23), (Y-26), (Y-35), (Y-36), (Y-37), (Y-38) and (Y-39) are preferred.

Further, it is possible to cite Compounds (Y-1) to (Y-33) from columns 19 to 24 of the aforementioned specification of U.S. Pat. No. 3,933,501, Compound Example (9) described in columns 7 and 8 of the specification of U.S. Pat. No. 4,046,575, Compound Example (1) as described in columns 5 and 6 of the specification of U.S. Pat. No. 4,133,958, Compound Example 1 described in column 5 of the specification of U.S. Pat. No. 4,401,752, and the following Compounds a) to g).

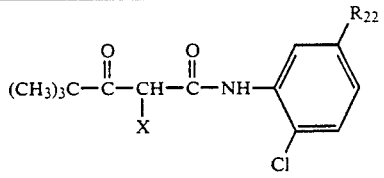

| Compound | $R_{22}$ | X |
|---|---|---|
| a | $-COO\overset{CH_3}{\overset{\vert}{C}}HCOOC_{12}H_{25}$ | 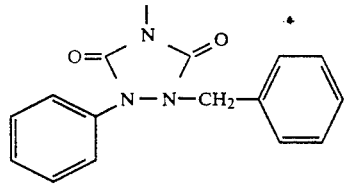 |
| b | $-COO\overset{C_4H_9}{\overset{\vert}{C}}HCOOC_{12}H_{25}$ | " |
| c | 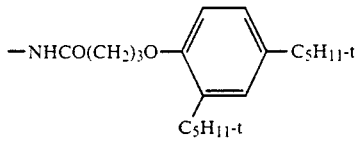 | 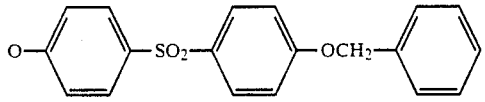 |
| d | " | 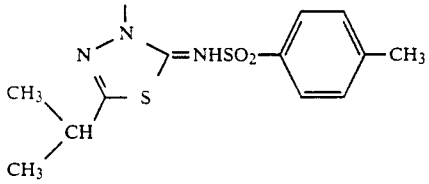 |
| e | " | 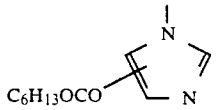 |
| f | $-NHSO_2C_{12}H_{25}$ | 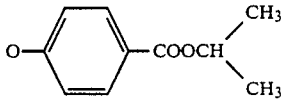 |
| g | $-NHSO_2C_{16}H_{33}$ | 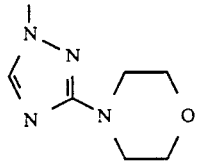 |

U.S. Pat. No. 4,623,616, among which (Y-2), (Y-7), (Y-8), (Y-12), (Y-20), (Y-21), (Y-23) and (Y-29) are preferred.

Additionally, it is also possible to cite as preferred examples, typical example (34) described in column 6 of the specification of U.S. Pat. No. 3,408,194, Compound Examples (16) and (19) described in column 8 of the Among the above couplers, those in which the terminal atom of a group released upon coupling (i.e., the atom connected directly to a coupler nucleus) is a nitrogen atom, are especially, preferred.

As magenta couplers which can be used in the present invention, the oil-protect hydrophobic indazolone or cyanoacetyl types, preferably the 5-pyrazolone type and pyrazolotriazoles or other such pyrazoloazole type couplers may be cited. In the case of the 5-pyrazolone type couplers, those with an arylamino group or acylamino substituent at the 3-position are preferred from the point of view of the hue of the developed dye and the color density, and typical examples are described in, for example, U.S. Pat. Nos. 2,311,082, 2,343,703, 2,600,788, 2,908,573, 3,062,653, 3,152,896 and 3,936,015. The releasable groups each containing a nitrogen atom connected to a coupler described in U.S. Pat. No. 4,351,897 are preferred as the releasable group in the 2-equivalent 5-pyrazolone type couplers. Further, a high color density is obtained with the 5-pyrazclone type couplers having a ballast group described in European Patent 73,636.

Examples of pyrazoloazole type couplers are the pyrazolobenzimidazoles described in U.S. Pat. No. 3,369,879, preferably the pyrazolo[5,1-c][1,2,4]triazoles described in U.S. Pat. No. 3,725,067, the pyrazolotetrazoles described in *Research Disclosure,* No. 24220 (June, 1984), and the pyrazolopyrazoles described in *Research Disclosure,* No. 24230 (June, 1984). Any of the couplers mentioned above may also be polymer couplers.

Specific examples of these compounds are those represented by the following formulae (M-1), (M-2) and (M-3).

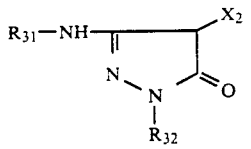

(M-1)

-continued

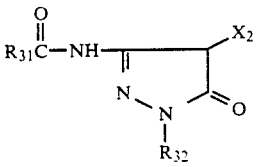

(M-2)

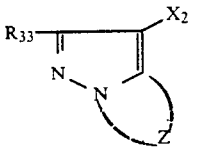

(M-3)

wherein $R_{31}$ represents a nondiffusible group with a total of 8 to 32 carbon atoms, $R_{32}$ represents a phenyl group or a substituted phenyl group, $R_{33}$ represents a hydrogen atom or a substituent group, Z represents a nonmetallic group of atoms necessary for the formation of a 5-membered azole ring which contains 2 to 4 nitrogen atoms, and the said azole ring may have substituents (including condensed rings), $X_2$ represents a hydrogen atom or a group which will be released.

Among the pyrazoloazole type couplers, the imidazo[1,2-b]pyrazoles described in U.S. Pat. No. 4,500,630 are preferred due to their light fastness and the low yellow secondary absorption of the developed dye, and pyrazolo[1,5-b][1,2,4]triazole described in U.S. Pat. No. 4,540,654 is specifically preferred.

Additionally, the use of the pyrazolotriazole couplers of the kind described in JP-A-61-65245, where a branched alkyl group is directly bonded at the 2-, 3- or 6-position of the pyrazolotriazole ring, the pyrazoloazole couplers containing a sulfonamido group within the molecule described in JP-A-61-65246, the pyrazoloazole couplers having an alkoxyphenylsulfonamido ballast group described in JP-A-61-147254 and the pyrazolotriazole couplers having an alkoxy group at the 6-position described in EP-A-226849, is also preferred.

Specific examples of these couplers are given below. However, the present invention is not to be construed as being limited to these examples.

| Compound | $R_{33}$ | $R_{34}$ | $X_2$ |
|---|---|---|---|
| | | 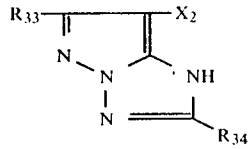 | |
| M-1 | $CH_3-$ | 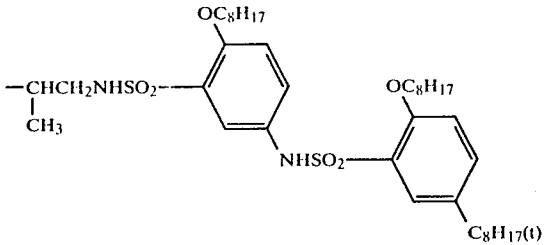 | Cl |
| M-2 | " | 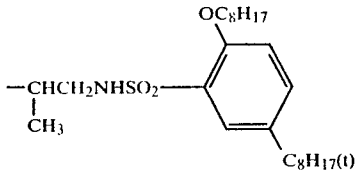 | " |
| M-3 | " | 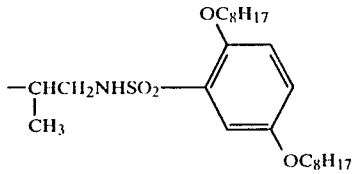 | 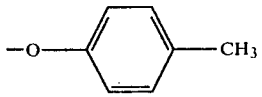 |
| M-4 | $CH_3-NHC(=O)NH-$ | 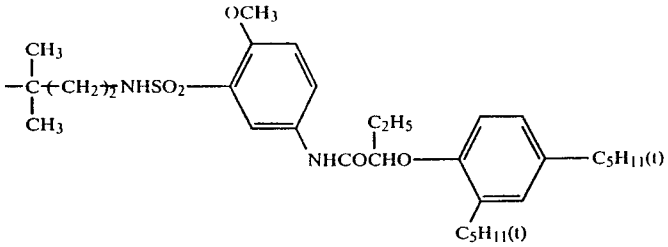 | 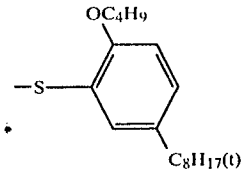 |

-continued
| Compound | $R_{33}$ | $R_{34}$ | $X_2$ |
|---|---|---|---|
| M-5 | $CH_3$— | 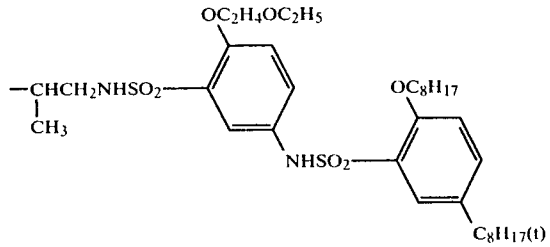 | Cl |
| M-6 | " | 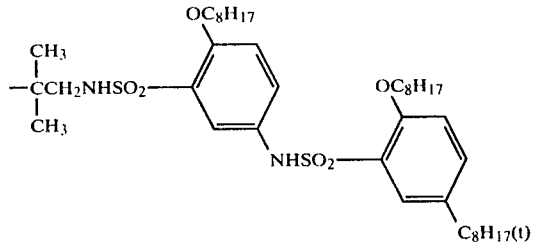 | " |
| M-7 | 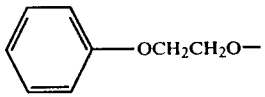 | 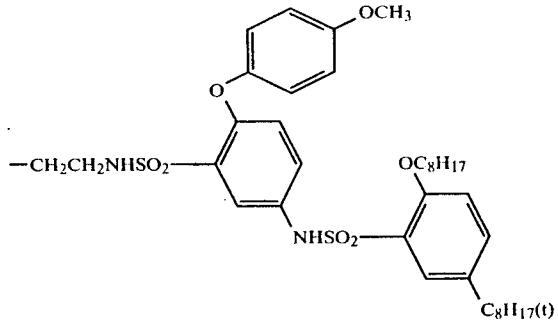 | 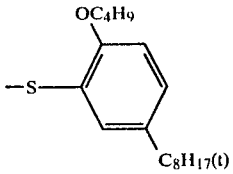 |
| M-8 | $CH_3CH_2O$— | " | " |

-continued
| Compound | $R_{33}$ | $R_{34}$ | $X_2$ |
|---|---|---|---|
| M-9 | " | 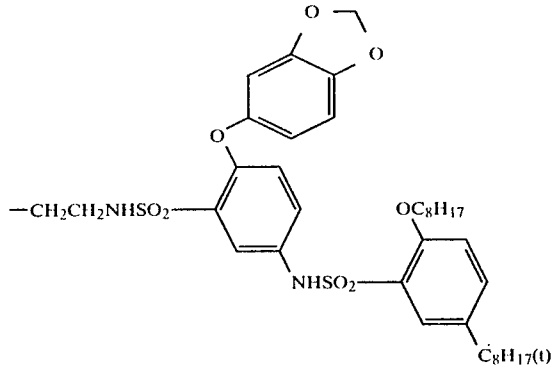 | " |
| M-10 | 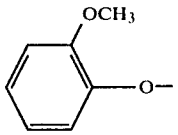 | 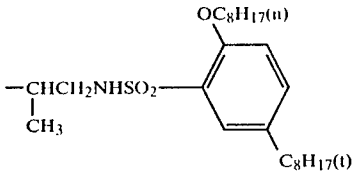 | Cl |
| | | 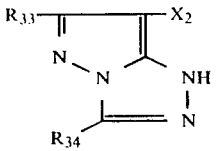 | |
| M-11 | $CH_3$— | 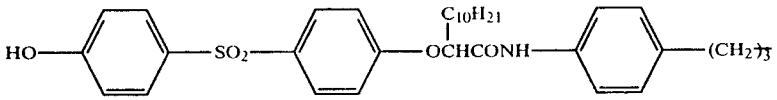 | Cl |
| M-12 | " | 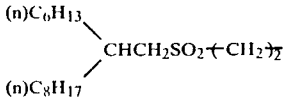 | " |

-continued
| Compound | $R_{33}$ | $R_{34}$ | $X_2$ |
|---|---|---|---|
| M-13 | 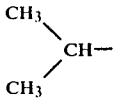 | 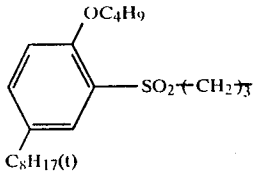 | " |
| M-14 | 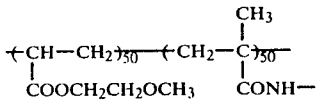 | 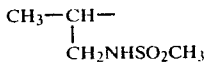 | " |
| M-15 | | 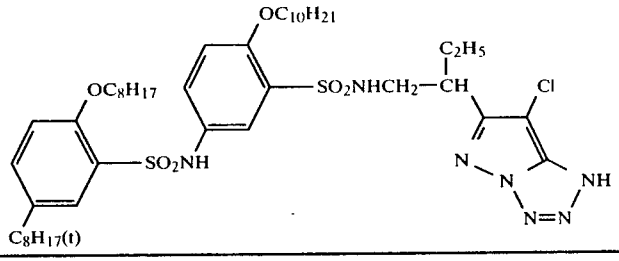 | |

The high boiling organic solvents which can be used as coupler solvents in the present invention are preferably solvents with a boiling point at normal pressure of at least 160° C., for example, esters (e.g., phosphoric acid esters, phthalic acid esters, fatty acid esters, and benzoic acid esters), phenols, aliphatic alcohols, carboxylic acids, ethers, amides (e.g., fatty acid amides, benzoic acid amides, sulfonic acid amides, and cyclic imides), aliphatic hydrocarbons, halide compounds, and sulfone derivatives. For the purposes of dissolving photographic additives such as the coupler in these high boiling organic solvents, where required, there may also be mixed a low boiling organic solvent of boiling point of 30° C. to 160° C. such as ethyl acetate, butyl acetate, ethyl propionate, or other such lower ester, or secondary butyl alcohol, methyl isobutyl ketone, cyclohexanone, 8-ethoxyethylacetate, or dimethylformamide, etc. These mixtures are emulsified and dispersed in an aqueous solution of hydrophilic colloid, and then used as a mixture with the photographic emulsion. At such a time, the low boiling organic solvent can be eliminated by vacuum concentration or water washing, etc.

The amount of high boiling organic solvent used will lie in the range of 0 to 20 parts by weight for 1 part by weight of the coupler and other photographic additives, preferably 0.2 to 3 parts by weight.

Examples of preferred high boiling organic solvents are given below, the present invention not being limited thereto.

$O{=}P(OCH_2\overset{C_2H_5}{\overset{|}{C}}HC_4H_9)_3$ (O-1)

$O{=}P(OCH_2CH_2\overset{CH_3}{\overset{|}{C}}HCH_2\overset{CH_3}{\overset{|}{\underset{CH_3}{\underset{|}{C}}}}{-}CH_3)_3$ (O-2)

$O{=}P(OC_{12}H_{25})_3$ (O-3)

$O{=}P(OCH_2CH_2OC_4H_9)_3$ (O-4)

$O{=}P(OCH_2CH_2CH_2Cl)_3$ (O-5)

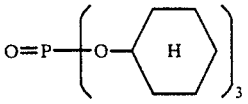

(O-6)

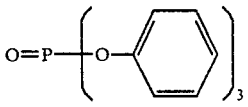

(O-7)

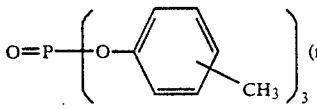

(m,p mixture) (O-8)

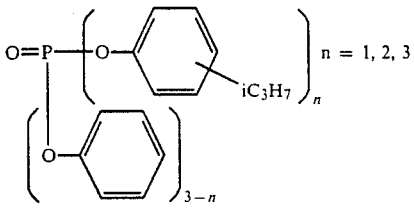

n = 1, 2, 3 (O-9)

-continued

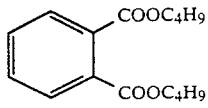

(O-10)

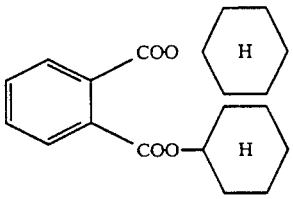

(O-11)

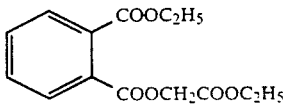

(O-12)

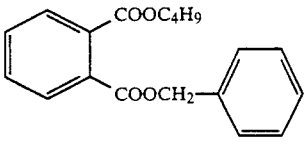

(O-13)

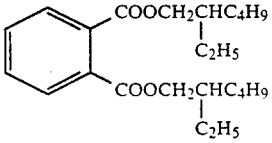

(O-14)

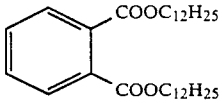

(O-15)

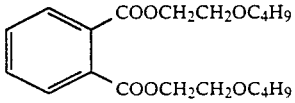

(O-16)

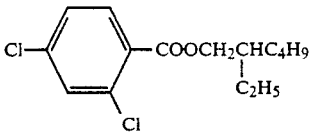

(O-17)

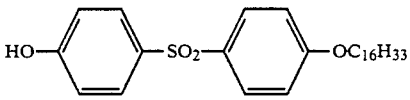

(O-18)

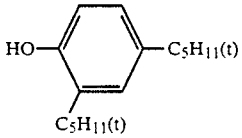

(O-19)

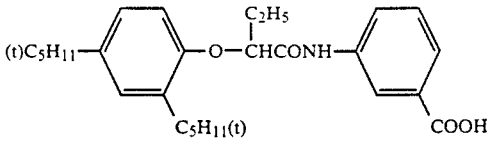

(O-20)

-continued (O-21)

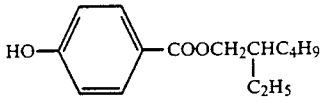

(O-22)

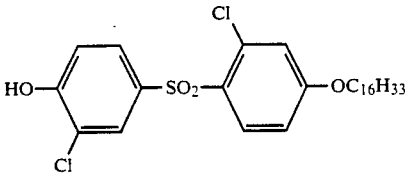

(O-23)

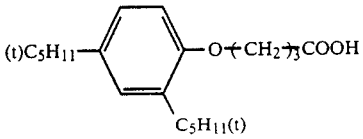

$C_8H_{17}CH{=}CH(CH_2)_7COOC_4H_9$ (O-24)

(O-25)

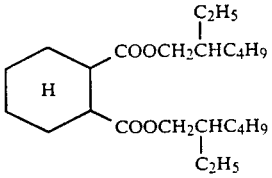

(O-26)

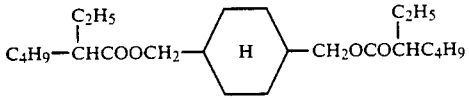

(O-27)

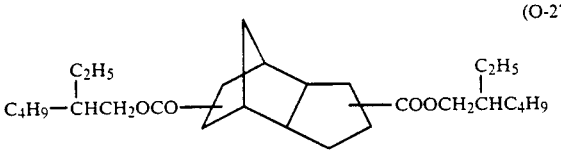

(O-28)

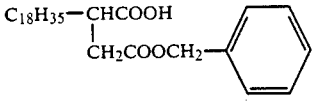

(O-29)

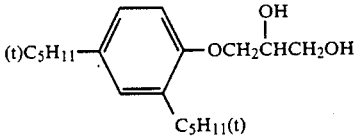

(O-30)

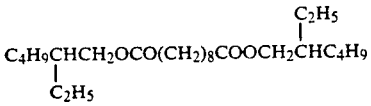

(O-31)

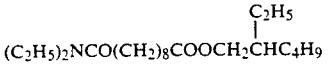

(O-32)

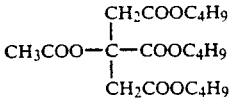

(O-33)

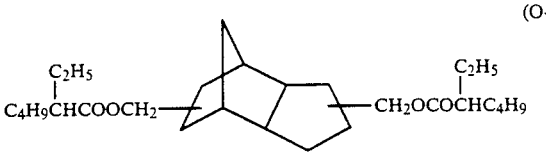

$C_nH_{2n+2}$ n = 10–20 (O-34)

$CH_3COCH_2COOC_{12}H_{25}$ (O-35)

(O-36)

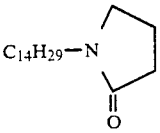

(O-37)

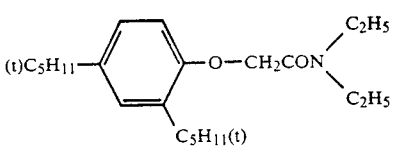

(O-38)

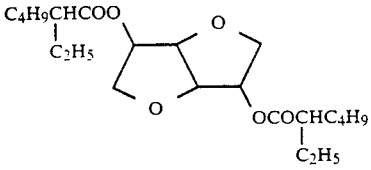

$C_{12}H_{28}Cl_8$ (chlorinated paraffin) (O-39)

(O-40)

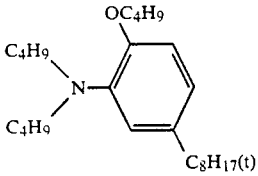

where $-C_8H_{17}(t) = -\underset{CH_3}{\overset{CH_3}{C}}-CH_2-\underset{CH_3}{\overset{CH_3}{C}}-CH_3$ (O-41)

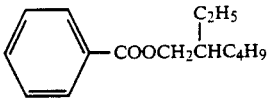

It is possible to enhance the effects of the present invention still further when at least one type of ultraviolet absorber is additionally used.

The ultraviolet absorber can be added to any layer, but preferably, the ultraviolet absorber will be incorporated into the layer containing the cyan coupler of the present invention, or into an adjacent layer. The group of compounds cited in Section VIII-C of *Research Disclosure,* No. 17643 are examples of compounds which can be used as ultraviolet absorbers in the present invention, but preferred examples are the benzotriazole derivatives represented by the following formula (XI).

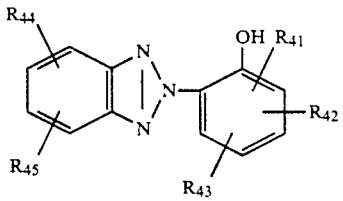

(XI)

In formula (XI), $R_{41}$, $R_{42}$, $R_{43}$, $R_{44}$ and $R_{45}$ may be the same or different, and they represent a hydrogen atom or a substituent. The aliphatic group $R_1$ explained in formula (I), or substituents for aryl group may be employed as these substituents. A 5- or a 6-membered aromatic ring comprising carbon atoms may also be formed by ring closure between $R_{44}$ and $R_{45}$. Such groups or such an aromatic ring may also be further substituted with substituents.

The compounds represented by the aforesaid formula (XI) may be used singly or in the form of a mixture of two or more. Some typical examples of ultraviolet absorbers which can be used in the present invention are given below, the present invention not being limited thereto. In these chemical structural formulae the

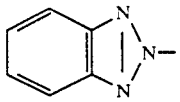

may also take the following structure by resonance.

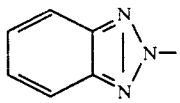

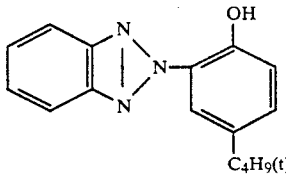

(UV-1)

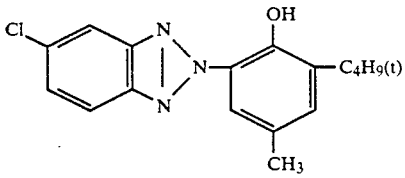

(UV-2)

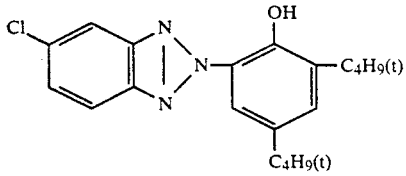

(UV-3)

-continued

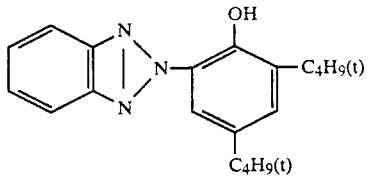

(UV-4)

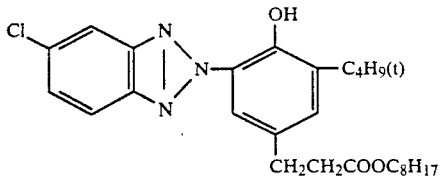

(UV-5)

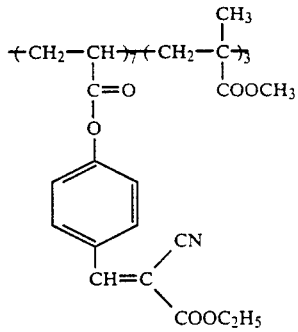

(UV-6)

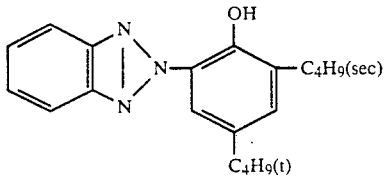

(UV-7)

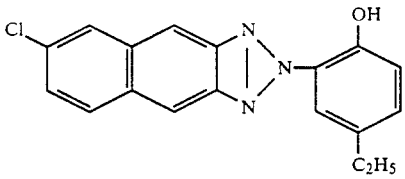

(UV-8)

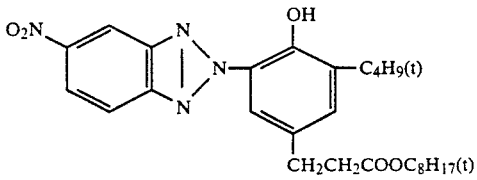

(UV-9)

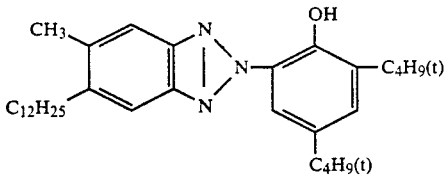

(UV-10)

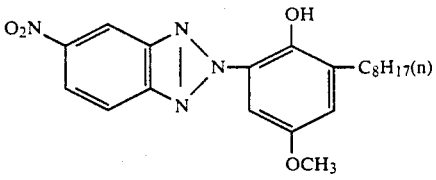

(UV-11)

-continued (UV-12)

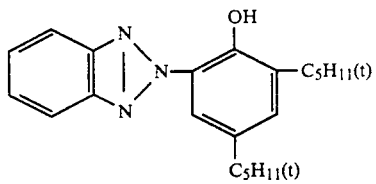

(UV-13)

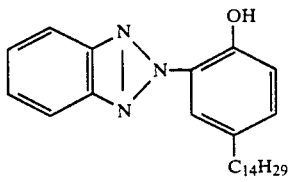

(UV-14)

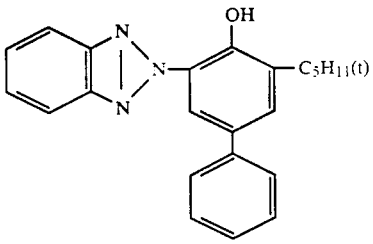

(UV-15)

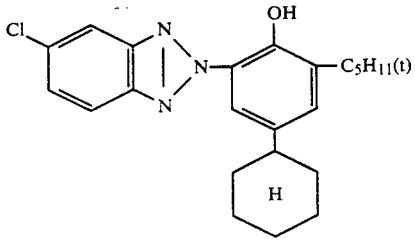

(UV-16)

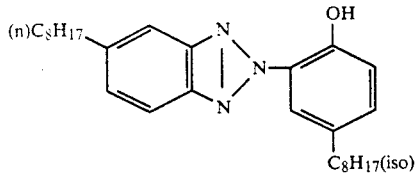

(UV-17)

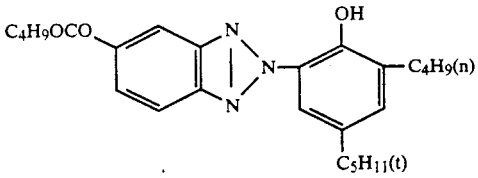

(UV-18)

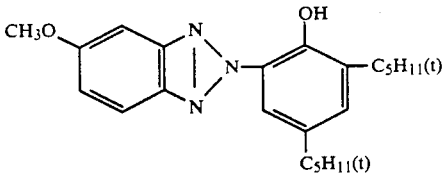

(UV-19)

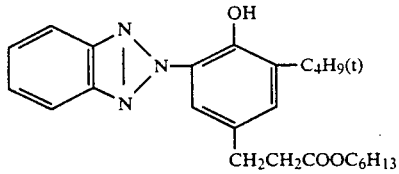

-continued (UV-20)

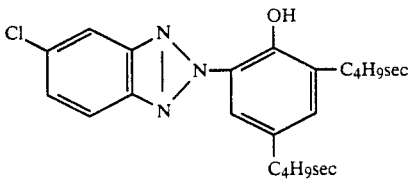

Methods of synthesizing the compounds represented by the aforesaid formula (XI), and other examples, are described in, for example, JP-B-44-29620 (the term "JP-B" as used herein means an "examined Japanese patent publication"), JP-A-50-151149 and 54-95233, U.S. Pat. No. 3,766,205, European Pat. No. 0057160, *Research Disclosure,* RD No. 22519 (1983). Furthermore, it is also possible to use the high molecular weight ultraviolet absorbers described in JP-A-58-111942 and 58-178351 (British Pat. No. 2,118,315A), U.S. Pat. No. 4,455,368, JP-A-59-19945 and 59-23344 (British Pat. No. 2,127,569A), a specific example being the above compound (UV-6). It is also possible to use in combination low molecular weight and high molecular weight ultraviolet absorbers.

The aforesaid ultraviolet absorbers can be emulsified and dispersed in the hydrophilic colloid by identical methods to those used for the couplers. There are no particular restrictions on the amounts of high boiling organic solvent and ultraviolet absorber, but normally an amount used of high boiling organic solvent is in the range of 0% to 300% in terms of the weight of ultraviolet absorber. It is preferred that a compound which is liquid at normal temperature be used alone or in combination.

When an ultraviolet absorber of the aforesaid formula (XI) is used in the coupler combination of the present invention, it is possible to improve the developed dye image, in particular the stability of the cyan image, especially its light resistance. The ultraviolet absorber and the cyan coupler may be emulsified together.

The amount of applied ultraviolet absorber should be sufficient to impart light stability to the cyan dye image, but if an excessive amount is used, unexposed regions of the color photographic light-sensitive material (white margins) may be turned yellow, so normally it is preferred that the amount be set in the range of from $1\times10^{-4}$ mol/m$^2$ to $2\times10^{-3}$ mol/m$^2$, in particular from $5\times10^{-4}$ mol/m$^2$ to $1.5\times10^{-3}$ mol/m$^2$.

Various types of reducing agent, including hydroquinone, can be cited as color mixing preventing agents for use in the present invention. The most typical examples are alkylhydroquinones, and in relation to the use of these as intermediate layer color mixing preventing agents, monoalkyl-substituted hydroquinones are described in, for example, U.S. Pat. Nos. 2,360,290, 2,419,613, 2,403,721, 3,960,570 and 3,700,453, JP-A-49-106329 and 50-156438, and dialkyl-substituted hydroquinones are described in, for example, U.S. Pat. Nos. 2,728,659, 2,732,300, 3,243,294 and 3,700,453, and JP-A-50-156438, 53-9528, 53-55121, 54-29637 and 60-55339. The alkylhydroquinones preferably used as color mixing preventing agents in the present invention are those with the following formula:

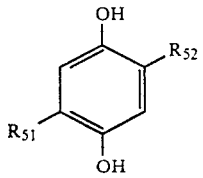

(XII)

wherein $R_{51}$ and $R_{52}$ each represents a hydrogen atom, or a substituted or unsubstituted alkyl group with 1 to 20 carbon atoms, (e.g., methyl, t-butyl, n-octyl, sec-octyl, t-octyl, sec-dodecyl, t-pentadecyl, sec-octadecyl), and one of $R_{51}$ and $R_{52}$ is an alkyl group.

Hydroquinone sulfonates, as described in U.S. Pat. No. 2,701,197 and JP-A-60-172040 can also be used advantageously as the color mixing preventing agents. Preferred hydroquinone sulfonates for use as color mixing preventing agents in the present invention are those represented by the following formula:

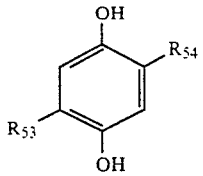

(XIII)

wherein $R_{53}$ represents a substituted or unsubstituted alkyl group, alkylthio group, amido group, or alkyloxy group, and $R_{54}$ represents a sulfo group or a sulfoalkyl group (e.g., sulfopropyl).

Amidohydrcquinones can also be used advantageously as the color mixing preventing agents. Descriptions of such compounds are to be found in, for example, JP-A-59-202465, and Japanese Pat. No. Application Nos. 60-165511 and 60-296088. Amidohydroquinones which are desirably employed as color mixing preventing agents in the present invention are those represented by the following formula:

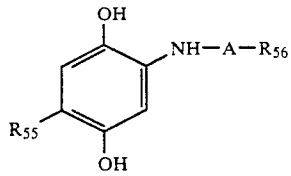

(XIV)

wherein $R_{55}$ represents a hydrogen atom, a halogen atom, or a substituted or unsubstituted alkyl group, A represents $$-\overset{\overset{\displaystyle O}{\|}}{C}- \quad \text{or} \quad -SO_2-,$$

and $R_{56}$ represents a substituted or unsubstituted alkyl group or aryl group.

Besides the alkylhydroquinones, hydroquinone sulfonates and amidohydroquinones represented by the above formulae, hydroquinones having electron attractive substituents described in, for example, JP-A-55-43521, 56-109344 and 57-22237 can also be used advantageously as color mixing preventing agents. Specific examples of the hydroquinones preferred as color mixing preventing agents are given below, the present invention not being limited thereto.

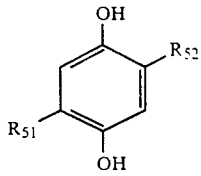

| Compound | $R_{51}$ | $R_{52}$ |
|---|---|---|
| HQ-1 | $(t)C_8H_{17}-$ | $-C_8H_{17}(t)$ |
| HQ-2 | $(t)C_6H_{13}-$ | $-C_6H_{13}(t)$ |
| HQ-3 | $(sec)C_8H_{17}-$ | $-C_8H_{17}(sec)$ |
| HQ-4 | $(n)C_8H_{17}-$ | $-C_8H_{17}(n)$ |
| HQ-5 | $CH_3-$ | $-C_8H_{17}(t)$ |
| HQ-6 | " | $-C_{18}H_{37}(sec)$ |
| HQ-7 | $(n)C_{16}H_{33}-$ | $-SO_3Na$ |
| HQ-8 | $(n)C_{16}H_{33}S-$ | " |
| HQ-9 | H | 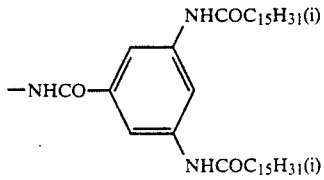 |
| HQ-10 | " | 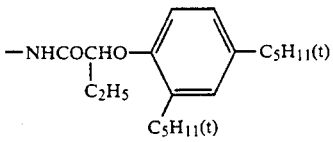 |

-continued

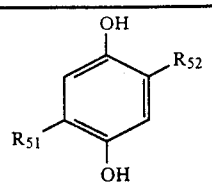

| Compound | $R_{51}$ | $R_{52}$ |
|---|---|---|
| HQ-11 | $(n)C_{15}H_{31}-$ | $-SO_2-$ 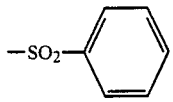 |
| HQ-12 | H | $-NHCO$ 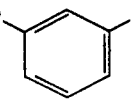 $NHCO$ $\leftarrow CH-CH_2\rightarrow_x \leftarrow CH-CH_2\rightarrow_y$ $COOC_4H_9$ |

x/y = 2/5
Average molecular weight: about 20,000

It is also possible to employ as the color mixing preventing agents reducing agents which are not structurally based on hydroquinone. Examples include the gallic acid amides given in JP-A-58-156933, and the sulfonamidophenols described in JP-A-59-5247 and 59-202465. Specific examples are given below, the present invention not being limited thereto.

(RD-1)

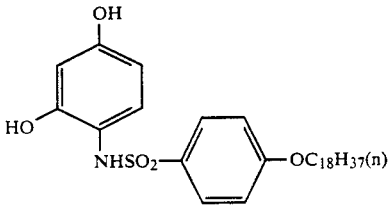

(RD-2)

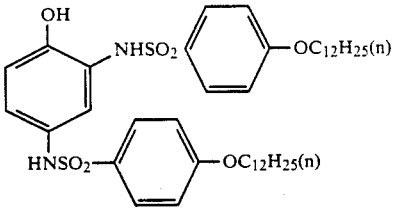

(RD-3)

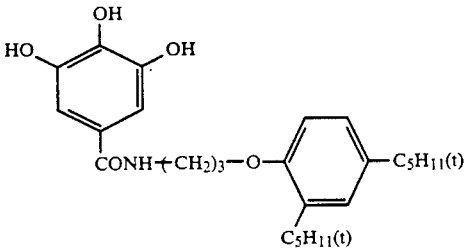

In order to enhance the stability of the developed dye image, in particular that of the yellow and magenta images, it is possible to use in addition various types of organic and metal complex type antidiscoloring agents. Examples of the organic antidiscoloring agents are hydroquinones, gallic acid derivatives, p-alkoxyphenols and p-oxyphenols, and patents relating to dye image stabilizers, stain preventatives and antioxidants are cited in sections VII (I to J) of *Research Disclosure,* RD No. 17643. Further, metal complex type antidiscoloring agents are described in, for example, *Research Disclosure,* RD No. 15162.

In order to improve the fastness of the yellow image to heat and light, many types of compounds can be used such as phenols, hydroquinones, hydroxycumarones, hydroxycumaranes, hindered amines and their alkyl ethers, silyl ethers or hydrolyzable precursors and derivatives.

Water-soluble dyestuffs may also be present as filter dyes in the hydrophilic colloid layers of the light-sensitive materials of the present invention, or as irradiation preventatives or for other such objectives. These dyes will include oxonol dyes, hemioxonol dyes, styryl dyes, merocyanine dyes, cyanine dyes and azo dyes. Among these, the oxonol dyes, hemioxonol dyes and merocyanine dyes are especially valuable.

The use of gelatin will be advantageous as the binder or protective colloid which can be employed in the emulsion layer of the light-sensitive materials of the present invention, but other hydrophilic colloids can also be used, either alone or in combination with gelatin.

In the present invention, the gelatin may be lime-treated material or material treated using acid. Details of the method of manufacturing gelatin are described in *The Macromolecular Chemistry of Gelatin,* by Arthur Veis (published by the Academic Press, 1964).

As the silver halide in the photographic emulsion layer of the photographic light-sensitive materials of the present invention there may be used silver bromide, silver iodobromide, silver iodochlorobromide, silver chlorobromide or silver chloride.

The average grain size of the silver halide grains in the photographic emulsion is not particularly restricted (in the case of grains which are spherical or close to spherical, grain size will be the grain diameter, and in the case of cubic grains, the length of an edge is taken as the grain size, the value being expressed as an average based on the projected area), but a grain size of no more than 2 μm is preferred.

The grain size distribution may be narrow or broad, but the use of a monodispersed emulsion with a percentage variation of no more than 15% is preferred.

The silver halide grains in a photographic emulsion layer may be grains with a regular crystal form such as cubic of octahedral, or grains with an irregular crystal form such as spherical and tabular, or alternatively they may be composites of these crystal forms. A mixture of different crystal forms of grains may also be employed. Among these, the use of an emulsion with regular such crystals is preferred.

Further, an emulsion may be used in which 50% or more of the total projected area is made up of silver halide grains which are tabular, and of grain diameter five or more times the grain thickness.

The silver halide grains may have a different phase in the interior and in the surface layer. Again, grains of a kind such that the latent image is formed primarily at the surface, or grains of a kind such that the latent image is formed primarily in the grain interior may also be used.

In the silver halide grain formation or in the physical ripening process, cadmium salts, zinc salts, thallium salts, lead salts, iridium salts or their complex salts, rhodium salts or their complex salts, iron salts or iron complex salts, etc., may also be introduced.

The silver halide emulsion will usually be chemically sensitized.

It is possible to incorporate various chemicals into the photographic emulsion used in the present invention, with the object of preventing fogging during the light-sensitive material manufacturing process, during storage or during the photographic treatment, or alternatively, with the object of stabilizing photographic performance. Specifically, it is possible to add many types of compound known as antifoggants or stabilizers such as azoles (e.g., benzothiazolium salts), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), mercaptopyrimidines, mercaptotriazines; thioketo compounds (e.g., oxazolinethione); azaindenes, e.g., triazaindenes, tetraazaindenes (in particular, 4-hydroxy substituted (1,3,3*a*,7)tetraazaindene), pentaazaindenes; benzenethiosulfonic acid, benzenesulfinic acid, benzenesulfonic acid amide.

The present invention may also be applied to multilayer, multicolored photographic materials having at least two different spectral sensitivities on the support. In the case of a multilayer natural color photographic material, there will normally be on the support at least one red-sensitive emulsion layer, green-sensitive emulsion layer and blue-sensitive emulsion layer, respectively. The order of the layers may be freely selected, as required. Normally, the cyan-forming coupler will be contained in the red-sensitive emulsion layer, the magenta-forming coupler in the green-sensitive emulsion layer, and the yellow-forming coupler in the blue-sensitive emulsion layer, but depending on the circumstances it is also possible to have different combinations.

The support employed in the present invention will normally be a cellulose nitrate film, a cellulose acetate film, a cellulose acetate butyrate film, a cellulose acetate propionate film, a polystyrene film, a polyethylene terephthalate film, a polycarbonate film, or a laminate of these, or a thin glass film, paper, or other such material used in photographic light-sensitive materials. Baryta or paper which has been coated with or laminated with an α-olefin polymer, in particular, polyethylene, polypropylene, ethylene-butene copolymer or other polymers of α-olefins with 2 to 10 carbon atoms, or vinyl chloride resin which contains a reflecting material such as $TiO_2$, or plastic film with a roughened surface described in JP-B-47-19068/72 and which has improved adhesion to other high polymer materials, also constitute supports which give excellent results. An ultraviolet-curing resin may also be used.

According to the particular objectives of the light-sensitive material, a transparent or a non-transparent such support will be selected. Again, by the addition of a dyestuff or pigment, it is also possible to produce tinted transparency.

As well as materials which are inherently opaque such as paper, the opaque supports will include transparent film to which there has been added a dye or pigment such as titanium oxide, etc., or plastic film which has been surface treated by a method such as is described in JP-B-47-19068, as well as paper or plastic film, etc., which has been rendered totally opaque by the addition of carbon black, a dyestuff, etc. It is normal to provide an undercoat layer on the support. In order to further improve adhesion, the support surface may be pretreated by means of a corona discharge, ultraviolet irradiation, flame treatment, etc.

The color light-sensitive materials which can be employed to produce color film of the present invention will be normal color light-sensitive materials, those for use in printing being especially ideal.

The color developing solution used for the developing treatment of the light-sensitive material of the present invention will preferably be an alkaline aqueous solution in which the chief component is an aromatic primary amine type color developing agent. While aminophenol type compounds are also useful as the color developing agent, the use of p-phenylenediamine type compounds is preferred, and specific examples are 3-methyl-4-amino-N,N-diethylaniline, 3-methyl-4-amino-N-ethyl-β-hydroxyethylaniline, 3-methyl-4-amino-N-ethyl-N-β-methanesulfonamidoethylaniline, 3-methyl-4-amino-N-ethyl-N-β -methoxyethylaniline and their sulfuric acid salts, hydrochloric acid salts or p-toluenesulfonic acid and salts. Where required, two or more of these compounds may be used together.

In general, the color developing solution will contain an alkali metal carbonate, borate or phosphate type pH buffer, bromide, iodide, benzimidazole, benzothiazole, or mercapto compound or other such developing inhibitor, or antifoggant, etc. Further, as required, other materials may be included, examples being preservatives such as hydroxylamine, diethylhydroxylamine, hydrazine sulfites, phenylsemicarbazides, triethanolamine, catechol sulfonic acids, and triethylenediamine (1,4-diazabicyclo[2,2,2]octane), organic solvents such as ethylene glycol, and diethylene glycol, developing accelerators such as benzyl alcohol, polyethylene glycol, quaternary ammonium salts, and amines, dye-forming couplers, competitive couplers, sodium borohydride or other such fogging agents, 1-phenyl-3-pyrazolidone or other such auxiliary developing agents, viscosity imparting agents, and various types of chelating agents as typified by aminopolycarboxylic acids, aminopolyphosphonic acids, alkylphosphonic acids and phosphonocarboxylic acids, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(ohydroxyphenylacetic acid) and their salts. From the point of view of environmental safety, it is preferred that benzyl alcohol is substantially not employed as a developing accelerator.

Furthermore, in the case where a reversal treatment is carried out, normally the color development will be performed after black-and-white developing. For the black-and-white developing liquid there may be used known black-and-white developing agents such as dihydroxybenzenes, e.g., hydroquinone, 3-pyrazolidones, e.g., 1-phenyl-3-pyrazolidone, or aminophenols, e.g., N-methyl-p-aminophenol. These may be used singly or in combinations.

In general, the pH of the color developing solution and of the black-and-white developing solution will be 9 to 12. Further, the amount of replenishment of these developers will depend on the color photographic light-sensitive material being treated but, in general, it will be up to 3 liters per square meter of light-sensitive material, and by reducing the bromide ion concentration in the replenisher, it is possible to employ 500 ml or less. In the case where the replenished quantity is reduced, it is preferred that liquid evaporation and air oxidation be prevented by reducing the area of contact between the treatment bath and the air. Moreover, it is also possible to reduce the replenishment by using a means for preventing the build-up of bromide ions in the developing liquid.

A photographic emulsion layer after color development is normally subjected to a bleaching treatment. The bleaching treatment may be carried out simultaneously with the fixing treatment (bleach-fixing treatment), or it may be carried out separately. Furthermore, in order to increase the speed of treatment, a method may be used in which a bleach-fixing treatment is performed after a bleaching treatment. Moreover, according to the objectives, it is possible to carry out treatment in a twin tank linked bleach-fixing bath, or to carry out a fixing treatment prior to the bleach-fixing treatment, or again to carry out a bleaching treatment after the bleach-fixing treatment. As the bleaching agents, there may be used, for example, compounds of multivalent metals such as iron (III), cobalt (III), chromium (VI), and copper (II), or peroxy acids, quinones, and nitro compounds, etc. Typical bleaching agents which can be used are ferricyanides; bichromates; organocomplexes of iron (III) or cobalt (III), e.g., complex salts of ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, and other such aminopolycarboxylic acid, tartaric acid, and malic acid; persulfates; bromates; permanganates; nitrobenzenes and the like. Among these, the aminopolycarboxylic acid iron (III) complexes, including the ethylenediaminetetraacetic acid iron (III) complex, and persulfates are preferred from the point of view of rapid treatment and preventing environmental pollution. Moreover, aminopolycarboxylic acid iron (III) complexes are especially valuable both in the bleaching liquid and in the bleach-fixing liquid. The pH of a bleaching liquid or bleach-fixing liquid employing such an aminopolycarboxylic acid iron (III) complex will normally be 5.5 to 8, but it is possible to employ a lower pH in order to increase the speed of the treatment.

Where required, it is possible to use a bleaching accelerator in the bleaching liquid, the bleach-fixing liquid and in baths prior to these. Specific examples of useful bleaching accelerators are described in the following specifications. There may be used compounds having a mercapto group or disulfide group described in, for example, U.S. Patent 3,893,858, West German Patents 1,290,812, 2,059,988, JP-A-53-32736, 53-57831, 53-37418, 53-72623, 53-95630, 53-95631, 53-104232, 53-124424, 53-141623, and 53-28426, and *Research Disclosure,* RD No. 17129 (July, 1978); thiazolidine derivatives described in JP-A-50-140129; thiourea derivatives described in JP-B-45-8506, JP-A-52- 20832, 53-32735, and U.S. Pat. No. 3,706,561; iodides described in West German Patent 1,127,715, and JP-A-58-16235; polyoxyethylene compounds described in West German Patents 966,410, and 2,748,430; polyamine compounds described in JP-B-45-8836, and furthermore, compounds described in JP-A-49-42434, 49-59644, 53-94927, 54-35727, 55-26506, and 58-163940; and bromide ions. Among these, the compounds with a mercapto group or disulfide group are preferred in that their accelerating effect is large, in particular the compounds described in U.S. Pat. No. 3,893,858, West German Pat. No. 1,290,812 and JP-A-53-95630. In addition, the compounds described in U.S. Pat. No. 4,552,834 are also preferred. These bleaching accelerators may also be added to the sensitive material. Such bleaching accelerators are especially effective when carrying out the bleach-fixing of photographic color light-sensitive materials.

Examples of the fixing agents which can be used are thiosulfates, thiocyanates, thioether type compounds, thioureas, and large amounts of iodides, but the use of thiosulfates is common, and in particular, ammonium thiosulfate is most widely used. Sulfites, bisulfites or carbonyl bisulfite adducts are preferred as preservatives for the bleach-fixing liquid.

The silver halide color photographic light-sensitive materials of the present invention will generally be subjected to water washing and/or a stabilizing process after the treatment to remove the silver. The amount of water used for washing in the washing process can be set over a wide range, depending on the characteristics of the light-sensitive material (e.g., the coupler and other materials used), the application, and also the water temperature, the number of washing tanks (number of stages), the replenishment system such as countercurrent or direct flow, and other such conditions. The relation between the amount of water and the number of washing tanks in a multistage countercurrent system can be determined by the method described in the *Journal of the Society of Motion Picture and Television Engineers,* Vol. 64, pp. 248 to 253 (May, 1955).

It is possible to reduce the amount of washing water markedly by means of the multistage countercurrent system described in the above reference but increasing the residence time of the water inside the tanks will allow bacteria to propagate, and problems occur such as the floating matter produced sticking to the light-sensitive material. As a means for overcoming such problems in the treatment of the color light-sensitive materials of the present invention, the method of reducing calcium ions and magnesium ions described in Japanese Pat. No. Application No. 61-131632 can be used extremely effectively. Furthermore, it is possible to use bactericides such as the isothiazolone compounds or thiabendazoles described in JP-A-57-8542, or chlorinated sodium isocyanurate or other chlorinated bactericides, as well as benzotriazoles, and other such bactericides, as described in *Bokin Bobaizai no Kagaku* (*The Chemistry of Antibacterial and Antifungal Agents*) by Hiroshi Horiguchi (1986), *Biseibutsu no Mekkin, Sakkin, Bogaigijutsu* (*Sterilizing, Disinfecting and Antifungal Technology*) by the Eisai Gijutsukai (Dds.) (1982) and *Bokin Bobaizai Jiten* (*Dictionary of Antibacterial and Antifungal Agents*) by the Nihon Bokin Bobai Gakkai (Eds.) (1986).

The pH of the washing water in the treatment of the light-sensitive materials of the present invention will be 4 to 9, preferably 5 to 8. The washing temperature and the washing time can be variously set according to the characteristics, application, etc., of the light-sensitive material, but in general a temperature in the range 15° to 45° C. and a time in the range 20 seconds to 10 minutes will be selected, preferably 25° to 40° C. and 30 seconds to 5 minutes. Furthermore, instead of water washing as described above, the light-sensitive materials of the present invention can also be treated directly by means of a stabilizing liquid. In such a stabilizing treatment, it is possible to employ all the known methods described in JP-A-57-8543, 58-14834 and 60-220345.

After the aforesaid water washing treatment, there may be a further stabilizing treatment. An example of this is the stabilizing bath containing formalin and surfactant used as the final bath for photographic color light-sensitive materials. It is also possible to add various chelating agents and antifungal agents to this.

The overflow liquid which accompanies replenishment of the aforesaid water washing and/or stabilizing liquid can be reused in the silver removal process or other processes.

With the object of simplifying the treatment and making it more rapid, the color developing agent may be incorporated into the silver halide color light-sensitive materials of the present invention. For the purpose of such incorporating, it is preferred that various precursors of the color developing agent be used. Examples are the indoaniline type compounds described in U.S. Pat. No. 3,342,597, the Schiff's base type compounds described in U.S. Pat. No. 3,342,599, *Research Disclosure,* RD No. 14850 and *ibid.,* No. 15159, the aldol compounds described in *Research Disclosure,* RD No. 13924, the metal complexes described in U.S. Pat. No. 3,719,492; and the urethane type compounds described in JP-A-53-135628.

The silver halide color light-sensitive materials of the present invention may also, where required, incorporate various types of 1-phenyl-3-pyrazolidones in order to accelerate the color development. Typical compounds are described in, for example, JP-A-56-64339, 57-144547 and 58-115438.

The various treatment liquids in the present invention are employed at 10° C. to 50 ° C. Normally, a temperature of 33° C. to 38° C. will be standard, but by raising the temperature, treatment is accelerated and the treatment time is shortened. Conversely, at a lower temperature, it is possible to enhance picture quality or improve the stability of the treatment solution. Furthermore, in order to reduce the silver in the light-sensitive material, it is possible to carry out treatment using a cobalt intensifier or hydrogen peroxide intensifier described in, for example, West German Patent 2,226,770 and U.S. Pat. No. 3,674,499.

The present invention will be explained below in more detail by means of some examples, but the invention is not to be construed as being limited to these examples.

EXAMPLE 1

10 g of Coupler (I-3) of the present invention, 10 g of dibutyl phthalate and 20 ml of ethyl acetate were heated to 50° C. The resulting solution was then emulsified and dispersed in 80 g of gelatin solution containing 8 ml of a 1% aqueous solution of sodium dodecylbenzenesulfonate.

This emulsion dispersion was mixed with 145 g of a red-sensitive silver chlorobromide emulsion (Br 50%; 7 g as silver), sodium dodecylbenzenesulfonate was added as a coating auxiliary, and then the mixture coated onto a paper support both faces of which had been laminated with polyethylene. The amount of coupler applied was set at 400 mg/m$^2$. A gelatin protective layer (1 g/m$^2$ of gelatin) was applied on the top of this layer. The sample obtained was designated as Sample A.

A number of films were prepared using the same procedure, but employing the combinations shown in Table 1 below instead of the aforesaid Coupler (I-3) and the dibutyl phthalate.

TABLE 1

| | | Epoxy | | High boling Organic Solvent | | |
|---|---|---|---|---|---|---|
| Film Sample | Coupler | No. | Added Amount (mg/m$^2$) | No. | Added Amount (mg/m$^2$) | Notes |
| A | (I-3) | — | — | (O-10) | 400 | Comparison |
| B | (I-3) | — | — | (O-8) | 400 | " |
| C | (I-2) | — | — | (O-10) | 400 | " |
| D | (I-3) | — | — | (O-6) | 400 | " |
| E | (I-6) | — | — | (O-8) | 400 | " |
| F | (I-8) | — | — | (O-8) | 400 | " |
| G | (I-17) | — | — | (O-8) | 400 | " |
| H | (a) | — | — | (O-8) | 400 | " |
| I | (a) | (II-5) | 400 | — | — | " |
| J | (b) | — | — | (O-8) | 400 | " |
| K | (b) | (II-5) | 400 | — | — | " |
| L | (I-2) | (II-1) | 400 | — | — | Invention |
| M | (I-2) | (II-5) | 400 | — | — | " |
| N | (I-3) | (II-5) | 200 | — | — | " |
| O | (I-3) | (II-5) | 200 | (O-8) | 200 | " |
| P | (I-3) | (II-5) | 200 | (O-8)* | 200 | " |
| Q | (I-3) | (II-5) | 200 | (O-6) | 200 | " |
| R | (I-3) | (II-5) | 200 | (O-10) | 200 | " |
| S | (I-3) | (II-5) | 200 | (O-30) | 200 | " |
| T | (I-3) | (II-6) | 400 | — | — | " |

TABLE 1-continued

| Film Sample | Coupler | Epoxy No. | Epoxy Added Amount (mg/m²) | High boling Organic Solvent No. | High boling Organic Solvent Added Amount (mg/m²) | Notes |
|---|---|---|---|---|---|---|
| U | (I-6) | (II-1) | 400 | — | — | " |
| V | (I-8) | (II-5) | 400 | — | — | " |
| W | (I-8) | (II-5) | 200 | (O-8) | 200 | " |
| X | (I-17) | (II-5) | 400 | — | — | " |

*Poly-tert-butyl methacrylate were added in the same amount.

Coupler a

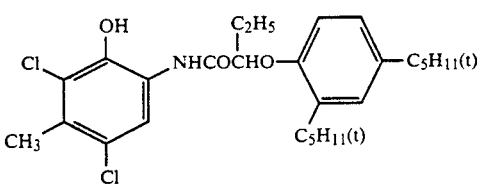

Coupler described in U.S. Pat. 4,239,851

Coupler b

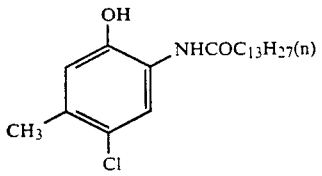

Coupler described in U.S. Pat. 4,239,851

After exposing each of these samples by means of a sensitometric continuous wedge, the following developing treatment was carried out.

| | |
|---|---|
| 1. Color Developing | 3 minutes 30 seconds |
| 2. Bleach-Fixing | 1 minute 30 seconds |
| 3. Water Washing | 1 minute 30 seconds |

The following materials were used in the various stages of the treatment process.

| | |
|---|---|
| Color Developing Solution: | |
| Benzyl alcohol | 15.0 ml |
| Diethylene glycol | 8.0 ml |
| Ethylenediaminetetraacetic acid | 5.0 g |
| Sodium sulfite | 2.0 g |
| Anhydrous potassium carbonate | 30 g |
| Hydroxylamine sulfate | 3.0 g |
| Potassium bromide | 0.6 g |
| 4-Amino-N-ethyl-N-(β-methanesulfonamidoethyl)-m-toluidine sesquisulfate monohydrate | 5.0 g |
| Water to make | 1 liter |
| pH | 10.2 |
| Bleach-Fixing Solution: | |
| Ethylenediaminetetraacetic acid | 4.0 g |
| Ethylenediaminetetraacetic acid ferric salt | 40 g |
| Sodium sulfite | 5.0 g |
| Sodium thiosulfate (70%) | 150 ml |
| Water to make | 1 liter |

Treatment was carried out after establishing a running state, without replenishment, based on the passage of 1 square meter of sensitive material per liter of color developer.

Next, a test was carried-out of the fastness of the developed samples. The fastness of the respective colored images was determined when the samples were left for 6 days in the dark at 100° C., when the samples were left for 6 weeks in the dark at 60° C. and 70% RH, and when the samples were subjected to 6 days exposure in a xenon tester (100,000 lux). Table 2 shows the percentage fall in density based on an initial density of 1.0. Further, it shows the cyan staining of the white margin, in terms of the increase in blue density of the unexposed regions when left for 10 days at 80° C.

TABLE 2

| Film Sample | Discoloration 100° C. 6 Days | Discoloration 60° C. 70% RH 6 Weeks | Discoloration Xenon 6 Days | Cyan Staining 80° C. 10 Days | Notes |
|---|---|---|---|---|---|
| A | 26 | 7 | 25 | +0.09 | Comparison |
| B | 23 | 6 | 26 | +0.10 | " |
| C | 22 | 6 | 24 | +0.08 | " |
| D | 23 | 7 | 25 | +0.09 | " |
| E | 21 | 6 | 24 | +0.10 | " |
| F | 19 | 5 | 28 | +0.08 | " |
| G | 23 | 7 | 24 | +0.10 | " |
| H | 61 | 15 | 38 | +0.13 | " |
| I | 42 | 11 | 36 | +0.13 | " |
| J | 72 | 21 | 41 | +0.08 | " |
| K | 57 | 16 | 38 | +0.06 | " |
| L | 19 | 5 | 22 | +0.02 | Invention |
| M | 17 | 4 | 21 | +0.01 | " |
| N | 16 | 4 | 20 | +0.02 | " |
| O | 18 | 5 | 21 | +0.02 | " |
| P | 14 | 3 | 18 | +0.02 | " |
| Q | 16 | 5 | 19 | +0.01 | " |
| R | 17 | 5 | 21 | +0.02 | " |
| S | 15 | 4 | 20 | +0.01 | " |
| T | 16 | 5 | 22 | +0.02 | " |
| U | 17 | 5 | 20 | +0.02 | " |
| V | 14 | 3 | 24 | +0.02 | " |
| W | 15 | 3 | 23 | +0.02 | " |
| X | 17 | 5 | 21 | +0.01 | " |

It will be clear from Table 2 that the cyan staining is markedly improved with the combinations in accordance with the present invention. Further, the combinations of the present invention have particularly outstanding fastness with respect to discoloration by heat, moist heat and light.

In the case of couplers a and b as described in U.S. Pat. No. 4,239,851, fastness is apparently enhanced, but considerable cyan staining can be seen (Samples H to K). With coupler b, which has a structure similar to that of the present invention, a slight improvement is observed in terms of both fastness and cyan staining, but when compared to the combinations of the present invention, the improvement is insufficient (Samples J and K). For these reasons too, the superiority of the combinations of the present invention is clear.

EXAMPLE 2

A multilayer photographic paper A-1 with a layer structure described below was produced on a paper support which was laminated on both sides with polyethylene. The coating liquids were prepared as follows.

Preparation of the First Layer Coating Liquid 27.2 cc of ethyl acetate and 7.7 cc (8.0 g) of high boiling organic solvent (aforesaid Solvent 0-10) were added to 10.2 g of Yellow Coupler (Y-1), 9.1 g of (Y-2) and 4.4 g of Color Image Stabilizer (Cpd-1), and a solution formed. This solution was emulsified and dispersed in 185 cc of 10% aqueous gelatin solution which contained 8 cc of 10% sodium dodecylbenzenesulfonate. This emulsion dispersion plus Emulsions EM1 and EM2 were mixed and dissolved together, the gelatin concentration adjusted to give the composition specified below and the first layer coating solution prepared. The coating liquids for the second layer through to the seventh layer were also prepared in the same manner as for the first layer coating liquid. 1-Hydroxy-3,5-dichloro-s-triazine sodium salt was used as the gelatin hardener for each layer. Further, (Cpd-12) was used as a viscosity increasing agent for the coating liquids.

Layer Structure

The composition of each layer is shown below. The numbers given represent coverage (g/m ) In the case of the silver halide emulsion, the coverage is given based on conversion to silver.

Support (The polyethylene on the first layer side contained white pigment ($TiO_2$) and blue dye.)

| | |
|---|---|
| First Layer: Blue-Sensitive Layer | |
| Monodispersed silver chlorobromide emulsion (EM1) spectrally sensitized with Sensitizing Dye (ExS-1) | 0.13 |
| Monodispersed silver chlorobromide emulsion (EM2) spectrally sensitized with Sensitizing Dye (ExS-1) | 0.13 |
| Gelatin | 1.86 |
| Yellow Coupler (Y-1) | 0.44 |
| Yellow Coupler (Y-2) | 0.39 |
| Color Image Stabilizer (Cpd-1) | 0.19 |
| Solvent (aforesaid O-10) | 0.35 |
| Second Layer: Color Mixing Preventive Layer | |
| Gelatin | 0.99 |
| Color Mixing Preventing Agent (Cpd-3) | 0.08 |
| Third Layer: Green-Sensitive Layer | |
| Monodispersed silver chlorobromide emulsion (EM3) spectrally sensitized with Sensitizing Dyes (ExS-2, ExS-3) | 0.05 |
| Monodispersed silver chlorobromide emulsion (EM4) spectrally sensitized with Sensitizing Dyes (ExS-2, ExS-3) | 0.11 |
| Gelatin | 1.80 |
| Magenta Coupler (M-1) | 0.32 |
| Color Image Stabilizer (Cpd-2) | 0.24 |
| Solvent (aforesaid O-8) | 0.12 |
| Solvent (aforesaid O-1) | 0.25 |
| Color Image Stabilizer (Cpd-8) | 0.03 |
| Color Image Stabilizer (Cpd-9) | 0.02 |
| Fourth Layer: Ultraviolet Absorbing Layer | |
| Gelatin | 1.60 |
| Ultraviolet Absorber (UV-1) | 0.62 |
| Color Mixing Preventing Agent (Cpd-3) | 0.05 |
| Solvent (aforesaid O-2) | 0.24 |
| Fifth Layer: Red-Sensitive Layer | |
| Monodispersed silver chlorobromide emulsion (EM5) spectrally sensitized with Sensitizing Dyes (ExS-4, ExS-5) | 0.07 |
| Monodispersed silver chlorobromide emulsion (EM6) spectrally sensitized with Sensitizing Dyes (ExS-4, ExS-5) | 0.16 |
| Gelatin | 1.44 |
| Cyan Coupler (aforesaid I-3) | 0.40 |
| Color Image Stabilizer (Cpd-10) | 0.17 |
| Color Image Stabilizer (Cpd-13) | 0.015 |
| Polymer for dispersion (Cpd-11) | 0.20 |
| High Boiling Organic Solvent (aforesaid O-8) | 0.24 |
| Sixth Layer: Ultraviolet Absorbing Layer | |
| Gelatin | 0.54 |
| Ultraviolet Absorber (UV-1) | 0.21 |
| Solvent (aforesaid O-2) | 0.08 |
| Stabilizer (Cpd-3) | 0.02 |
| Seventh Layer: Protective Layer | |
| Gelatin | 1.33 |
| Acrylic-modified polyvinyl alcohol copolymer (degree of modification 17%) | 0.17 |
| Liquid paraffin | 0.03 |

Further, (Cpd-4, Cpd-5) were used at this time as irradiation preventing dyes.

Moreover, there were used in each layer as emulsion dispersants and coating auxiliaries, Alkanol XC (Du Pont), sodium alkylbenzenesulfonate, succinate ester and Magefacx F-120 (manufactured by Dainippon Ink). (Cpd-6, Cpd-7) were used as silver halide stabilizers.

The compounds used in this example are given below. The couplers have been described earlier.

ExS-1

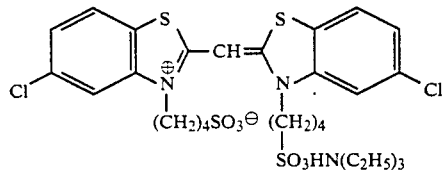

ExS-2

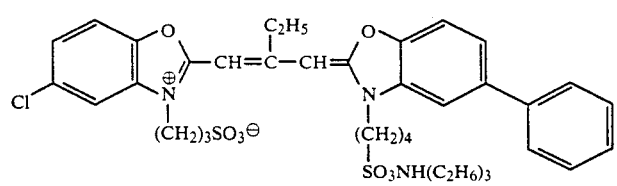

-continued
ExS-3
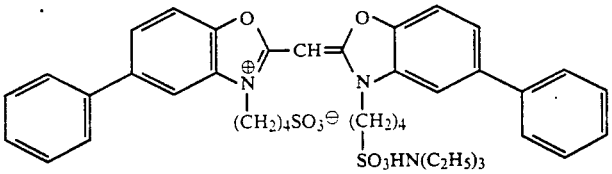
ExS-4
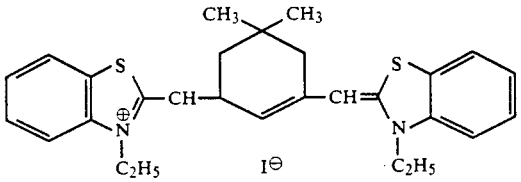
ExS-5
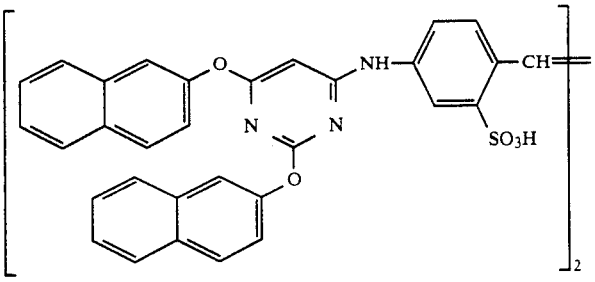
Y-1
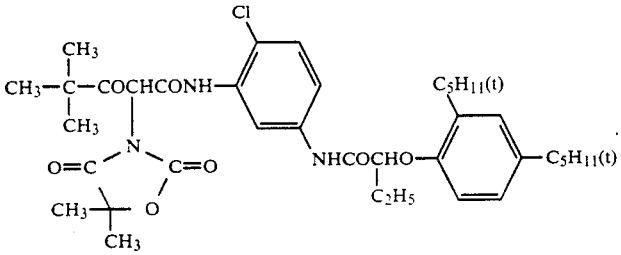
Y-2
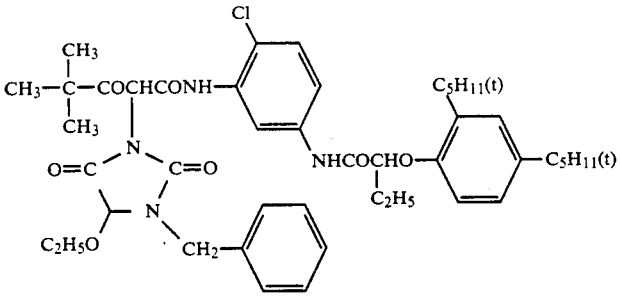
M-1
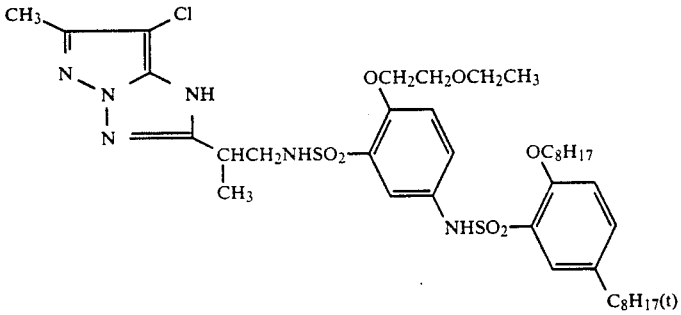

-continued
Cpd-1
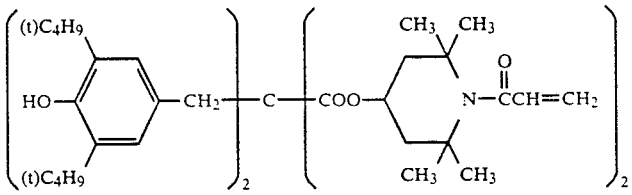
Cpd-2
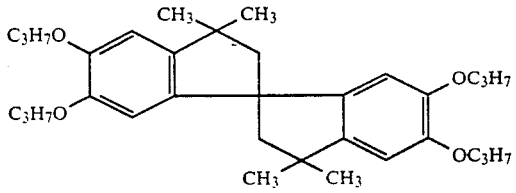
Cpd-3
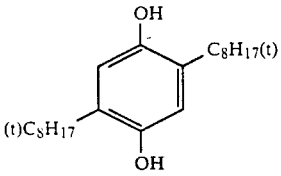
Cpd-4
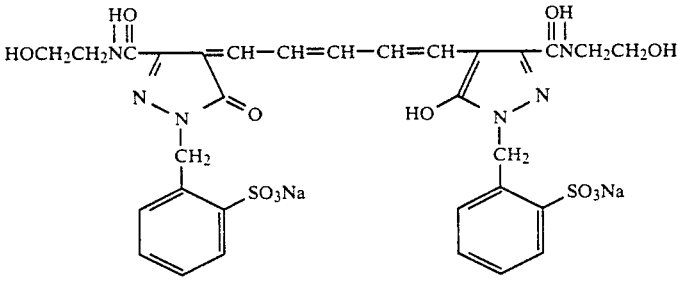
Cpd-5
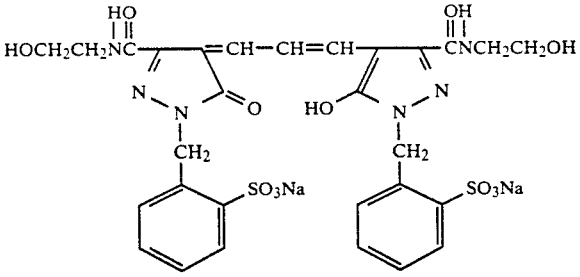
Cpd-6
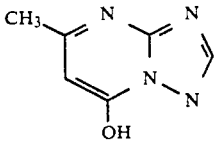
Cpd-7
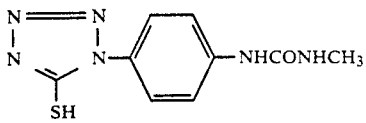

-continued
Cpd-8
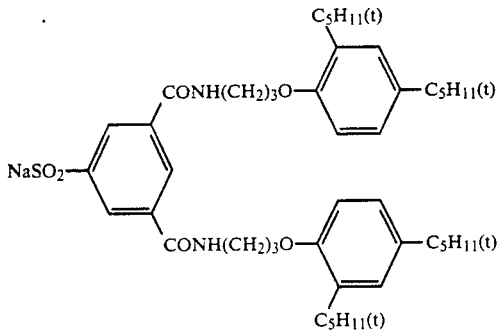
Cpd-9
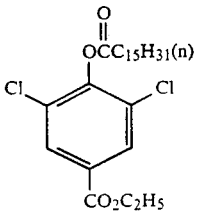
UV-1 (Ultraviolet Absorber)
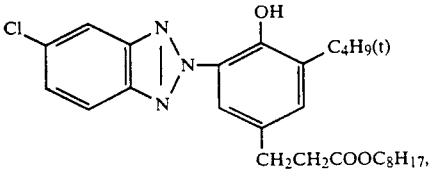
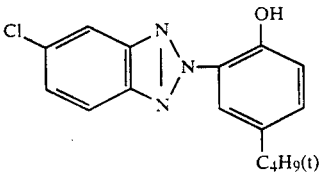
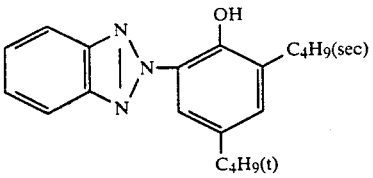
(2:9:8 mixture, by weight)
Cpd-10 (Color Image Stabilizer)
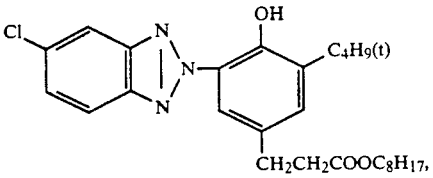
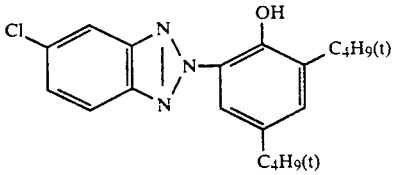

-continued

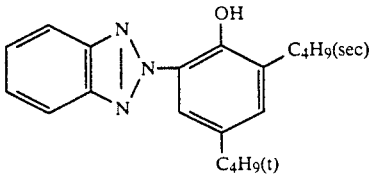

(5:8:9 mixture, by weight)

Cpd-11

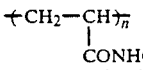

Average molecular weight 80,000

Cpd-12

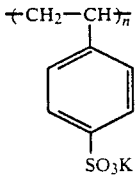

Cpd-13

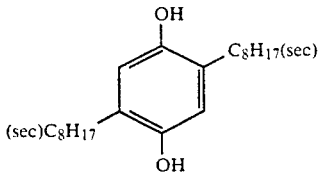

EM1 to EM6: Silver chlorobromides

| Emulsion | Grain Shape | Average Grain Diameter* (μ) | Br (mol %) | Coefficient of Variation** |
|---|---|---|---|---|
| EM1 | Cubic | 1.0 | 80 | 0.08 |
| EM2 | " | 0.75 | 80 | 0.07 |
| EM3 | " | 0.5 | 83 | 0.09 |
| EM4 | " | 0.4 | 83 | 0.10 |
| EM5 | " | 0.5 | 73 | 0.09 |
| EM6 | " | 0.4 | 73 | 0.10 |

*Average of lengths of side in projection
**Statistically, this expresses the ratio of the standard deviation (s) to the average grain diameter (d̄), i.e., (s/d̄)

Next, Sample (A-2) to (A-15) were produced by changing only the coupler, epoxy and high boiling organic solvent in the composition of the fifth layer (red-sensitive layer) of Sample (A-1), as shown in Table 3 below.

After exposing these samples (A-1) to (A-15) through an optical wedge, treatment was carried out by the treatment method (II) shown below following the establishment of the running state. (Running was carried out without replenishment, based on 1 $m^2$ of sensitive material passing per liter of color developing solution.)

These samples obtained following color development were then evaluated for cyan staining by a method identical to that in Example 1 above.

| Treatment Process | Temperature (°C.) | Time |
|---|---|---|
| Color Development | 38 | 1 min 40 sec |
| Bleach-Fixing | 30–34 | 1 min 0 sec |
| Rinse (1) | 30–34 | 20 sec |
| Rinse (2) | 30–34 | 20 sec |
| Rinse (3) | 30–34 | 20 sec |
| Drying | 70–80 | 50 sec |

(A countercurrent system was used for the three rinsing tanks, i.e., (3) to (1).)

The compositions of each of the treatment solutions were as follows:

| | |
|---|---|
| Color Developing Solutions: | |
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 3.0 g |
| Fluorescent whitening agent (WHITEX4B, manufactured by Sumitomo Chemicals) | 1.5 g |
| Water to make | 1,000 ml |
| pH (25° C.) | 10.25 |
| Bleach-Fixing Solution: | |
| Water | 800 ml |
| Ammonium thiosulfate (70%) | 200 ml |
| Sodium sulfite | 20 g |
| Ammonium ethylenediaminetetraacetato ferrate (III) | 60 g |
| Disodium ethylenediaminetetraacetate | 10 g |
| Water to make | 1,000 ml |
| pH (25° C.) 7.00 | |
| Rinsing Solution: | |
| Benzotriazole | 1.0 g |
| Ethylenediamine-N,N,N',N'-tetramethylene phosphonic acid | 0.3 g |
| Water to make | 1,000 ml |
| pH (25° C.) 7.50 | |

TABLE 3

| Film Sample | Coupler | Epoxy No. | Epoxy Added Amount (mg/m²) | High Boling Organic Solvent No. | High Boling Organic Solvent Added Amount (mg/m²) | Cyan Staining | Notes |
|---|---|---|---|---|---|---|---|
| A-1 | (I-3) | — | — | (O-8) | 0.24 | +0.09 | Comparison |
| A-2 | (I-3) | — | — | (O-10) | 0.24 | +0.07 | " |
| A-3 | (I-4) | — | — | (O-8) | 0.24 | +0.08 | " |
| A-4 | (I-14) | — | — | (O-8) | 0.24 | +0.07 | " |
| A-5 | (I-15) | — | — | (O-8) | 0.24 | +0.08 | " |
| A-6 | (I-20) | — | — | (O-8) | 0.24 | +0.09 | " |
| A-7 | (I-3) | (II-1) | 0.24 | — | — | +0.01 | Invention |
| A-8 | (I-3) | (II-1) | 0.12 | (O-8) | 0.12 | +0.02 | " |
| A-9 | (I-3) | (II-5) | 0.12 | (O-10) | 0.12 | +0.01 | " |
| A-10 | (I-4) | (II-5) | 0.24 | — | — | +0.01 | " |
| A-11 | (I-4) | (II-5) | 0.12 | (O-8) | 0.12 | +0.02 | " |
| A-12 | (I-14) | (II-1) | 0.24 | — | — | +0.00 | " |
| A-13 | (I-14) | (II-1) | 0.12 | (O-8) | 0.12 | +0.01 | " |
| A-14 | (I-15) | (II-5) | 0.24 | — | — | +0.01 | " |
| A-15 | (I-15) | (II-5) | 0.24 | — | — | +0.01 | " |

It is clear from Table 3 too that as a result of the present invention, there is a marked improvement with respect to the problem of cyan staining.

EXAMPLE 3

Multilayer Photographic Papers B-1 to B-15 were produced in the same way as for the Multilayer Photographic Papers A-1 to A-15 used in Example 2 above, except that Em1 to EM6 were replaced respectively by EM7 to EM12 as specified below. Exposure and treatment were carried out in the same way as in Example 2, using treatment method (III) described below. Results identical to those in Example 2 were obtained. (Whereas the cyan staining ranged from +0.02 to +0.03 in the comparative samples, no cyan staining was observed in the samples in accordance with the present invention.)

| Emulsion | Grain Shape | Average Grain Size (μ)* | Br Content (mol %) | Coefficient of Variation** |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

*Average of lengths of side in projection
**Statistically, this expresses the ratio of the standard deviation (s) and the average grain diameter (d), i.e., s/d.

| Bleach-Fixing Solution: | |
|---|---|
| Water | 400 ml |
| Ammonium thiosulfate (70%) | 100 ml |
| Sodium sulfite | 18 g |
| Ammonium ethylenediaminetetraacetato ferrate (III) | 55 g |
| Disodium ethylenediaminetetraacetate | 3 g |
| Ammonium bromide | 40 g |
| Glacial acetic acid | 8 g |
| Water to make | 1,000 ml |
| pH (25° C.) | 5.5 |

RINSING SOLUTION

Ion exchange water (calcium and magnesium both below 3 ppm)

| Treatment Process | Temperature (°C.) | Time (seconds) |
|---|---|---|
| Color Developing | 35 | 45 |
| Bleach-Fixing | 30-35 | 45 |
| Rinse (1) | 30-35 | 20 |
| Rinse (2) | 30-35 | 20 |
| Rinse (3) | 30-35 | 20 |
| Rinse (4) | 30-35 | 30 |
| Drying | 70-80 | 60 |

(A three-tank countercurrent system was employed for the rinsing tanks (4) to (1).)

The composition of the treating solution was as follows.

| Color Developing Solution: | |
|---|---|
| Water | 800 ml |
| Ethylenediamine-N,N,N,N-tetramethylene phosphonic acid | 1.5 g |
| Triethylenediamine(1,4-diazabicyclo-[2,2,2]octane) | 5.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| Fluorescent whitening agent (UVITEX CK, Ciba Geigy) | 2.0 g |
| Water to make | 1,000 ml |
| pH (25° C.) | 10.10 |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a layer containing (a) at least one cyan dye-forming coupler represented by formula (I) below and (b) at least one difficultly water-soluble epoxy represented by formula (II) below and having a solubility in water at 25° C. of 10 weight % or less:

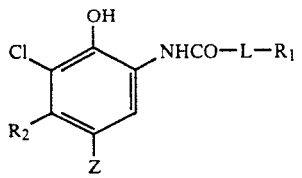

(I)

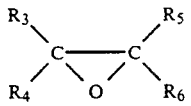

(II)

wherein $R_1$ is selected from the group consisting of $-C_8H_{17}$, $-C_9H_{19}$, $-C_{10}H_{21}$, $C_{11}H_{23}$, $-C_{12}H_{25}$, $-C_{13}H_{27}$, $-C_{15}H_{31}$, $-C_{16}H_{33}$, $-C_{17}H_{35}$, $-C_{21}H_{43}$,

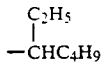

$R_2$ represents an ethyl group, L represents a simple linkage or a bivalent linking group, Z represents a chlorine atom or a fluorine atom, $R_3$, $R_4$, $R_5$ and $R_6$ each represents a hydrogen atom, an aliphatic group, an aliphatic oxycarbonyl group, an aromatic oxycarbonyl group or a carbamoyl group, provided that $R_3$, $R_4$, $R_5$ and $R_6$ are not all hydrogen atoms, and the total number of carbon atoms thereof is from 8 to 60, and in formula (II), a 5- to 7-membered ring may be formed with $R_3$ and $R_4$ or $R_3$ and $R_5$, respectively, and wherein the amount of the epoxy represented by formula (II) for 1 part by weight of the coupler of formula (I) is from 0.2 to 2 parts by weight, and wherein the epoxy is employed along with the coupler by using a surfactant to achieve emulsion dispersion in a hydrophilic binder.

2. A silver halide photographic light-sensitive material as in claim 1, wherein the coupler and the epoxy are present in the same oil droplets.

3. A silver halide photographic light-sensitive material as in claim 1, wherein the amount of coupler contained in a silver halide emulsion layer from which a light-sensitive layer is constructed is 0.1 to 1.0 mol.

4. A silver halide photographic light-sensitive material as in claim 3, wherein the amount of coupler contained in a silver halide emulsion layer from which a light-sensitive layer is constructed is 0.1 to 0.5 mol.

5. A silver halide photographic light-sensitive material as in claim 1, wherein the coupler of formula (I) and the epoxy of formula (II) are coemulsified and dispersed in the form of fine grains in a silver halide emulsion layer.

6. A silver halide, photographic light-sensitive material as in claim 5, wherein the coemulsification is effected in the presence of a high-boiling organic solvent.

7. A silver halide photographic light-sensitive material as in claim 1, wherein the coupler of formula (I), the epoxy of formula (II), and a ultraviolet absorber of formula (XI) below:

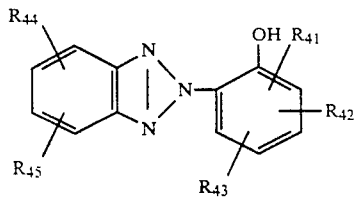

(XI)

wherein $R_{41}$, $R_{42}$, $R_{43}$, $R_{44}$ and $R_{45}$ may be the same or different, and they represent a hydrogen atom or a substituent, are coemulsified.

8. A silver halide photographic light-sensitive material as in claim 7, wherein the ultraviolet absorber is contained in an amount of $1\times10^{-4}$ to $2\times10^{-3}$ mol/m$^2$.

9. A silver halide photographic light-sensitive material as in claim 1, which further comprises an alkylhydroquinone represented by formula (XII) below, a hydroquinone sulfonate represented by formula (XIII) below or an amidohydroquinone represented by formula (XIV) below:

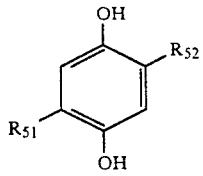

(XII)

wherein $R_{51}$ and $R_{52}$ each represents a hydrogen atom, or a substituted or unsubstituted alkyl group with 1 to 20 carbon atoms, and one of $R_{51}$ and $R_{52}$ is an alkyl group;

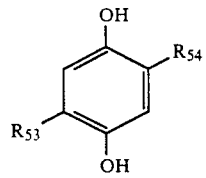

(XIII)

wherein $R_{53}$ represents a substituted or unsubstituted alkyl group, alkylthio group, amido group, or alkyloxy group, and $R_{54}$ represents a sulfo group or a sulfoalkyl group;

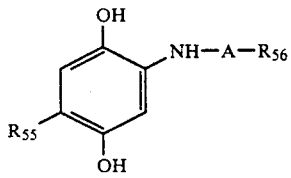

(XIV)

wherein $R_{55}$ represents a hydrogen atom, a halogen atom, or a substituted alkyl group, A represents

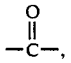

or $-SO_2-$, and $R_{56}$ represents a substituted or unsubstituted alkyl group or aryl group.

10. A silver halide photographic light-sensitive material as in claim 9, wherein the hydroquinone is contained in an intermediate layer between a red-sensitive silver halide emulsion layer and a green-sensitive silver halide emulsion layer.
11. A silver halide photographic light-sensitive material as in claim 1, wherein L is selected from the group consisting of a simple linkage,
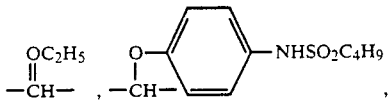
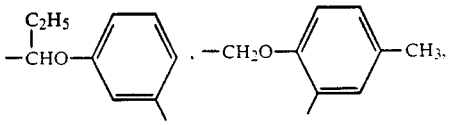
-continued
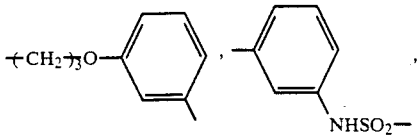
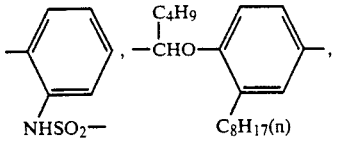
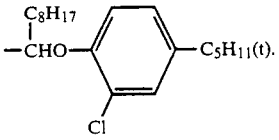
12. A silver halide photographic light-sensitive material as in claim 1, wherein L represents a simple linkage.
* * * * *